US005407201A

United States Patent [19]

Whitehurst

[11] Patent Number: 5,407,201

[45] Date of Patent: Apr. 18, 1995

[54] EDUCATIONAL PUZZLE AND METHOD OF CONSTRUCTION

[76] Inventor: Timothy D. Whitehurst, 303 Wash. Xing.-Penn Rd., Titusville, N.J. 08560

[21] Appl. No.: 36,546

[22] Filed: Mar. 23, 1993

[51] Int. Cl.[6] ..... A63F 9/10

[52] U.S. Cl. ..... 273/157 R; 273/156; 273/153 P

[58] Field of Search ..... 273/156, 157 R, 153 P

[56] References Cited

U.S. PATENT DOCUMENTS

| | | | |
|---|---|---|---|
| 3,565,442 | 2/1971 | Klein | 273/157 R |
| 3,637,215 | 1/1972 | Keister | 273/155 |
| 3,637,216 | 1/1972 | Keister | 273/156 |
| 3,637,217 | 1/1972 | Kent | 273/157 R |
| 3,655,201 | 4/1972 | Nichols | 273/153 R |
| 3,788,645 | 1/1974 | Nelson | 273/156 |
| 3,993,313 | 11/1976 | Tillotson | 273/157 R |
| 4,133,538 | 1/1979 | Ambrose | 273/157 R |
| 4,257,609 | 3/1981 | Squibbs | 273/157 R |
| 4,307,886 | 12/1981 | Kemper | 273/157 R |
| 4,308,016 | 12/1981 | White | 273/157 R |
| 4,826,171 | 5/1989 | Morse | 273/160 |
| 4,934,701 | 6/1990 | Ting | 273/157 R |
| 5,108,100 | 4/1992 | Essebaggers et al. | 273/157 R |

FOREIGN PATENT DOCUMENTS 2225247 5/1990 United Kingdom ..... 273/153 P

OTHER PUBLICATIONS

Triazzle-in Wide World of Games Catalog-Spring 1993 (attached) pp. 40–41.

*Primary Examiner*—Vincent Millin
*Assistant Examiner*—Steven B. Wong

[57] ABSTRACT

A puzzle is disclosed which consists of a three-dimensional geometric structure made up of a plurality of smaller three-dimensional structures, or pieces, that feature a plurality of indicia overlapping their edges. When correctly assembled, completed indicia appear on all surfaces, both exposed and non-exposed, as the portion of the indicium on each piece's surface matches the complementary portion of that indicium at the adjoining piece surface at the intersecting edge of the adjacent pieces. Construction consists of selecting a desired puzzle shape, selecting a set of smaller sub-division pieces which when assembled form the desired final shape, identifying the edges of the pieces which are adjacent to one another in the completed puzzle, selecting a desired set of indicia and overlapping the indicia over the edges such that completed indicia are observed on all adjoining faces.

11 Claims, 13 Drawing Sheets

Fig 2A
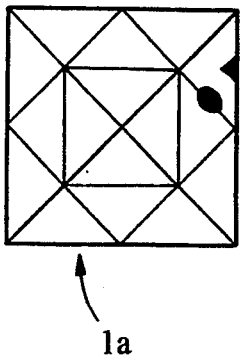
Fig 2B
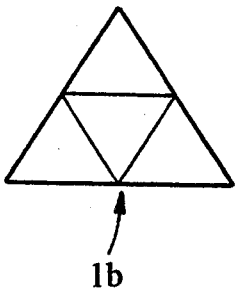
Fig 2C
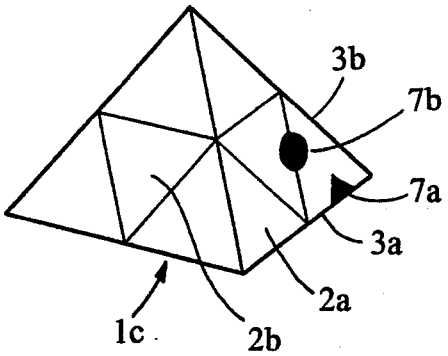
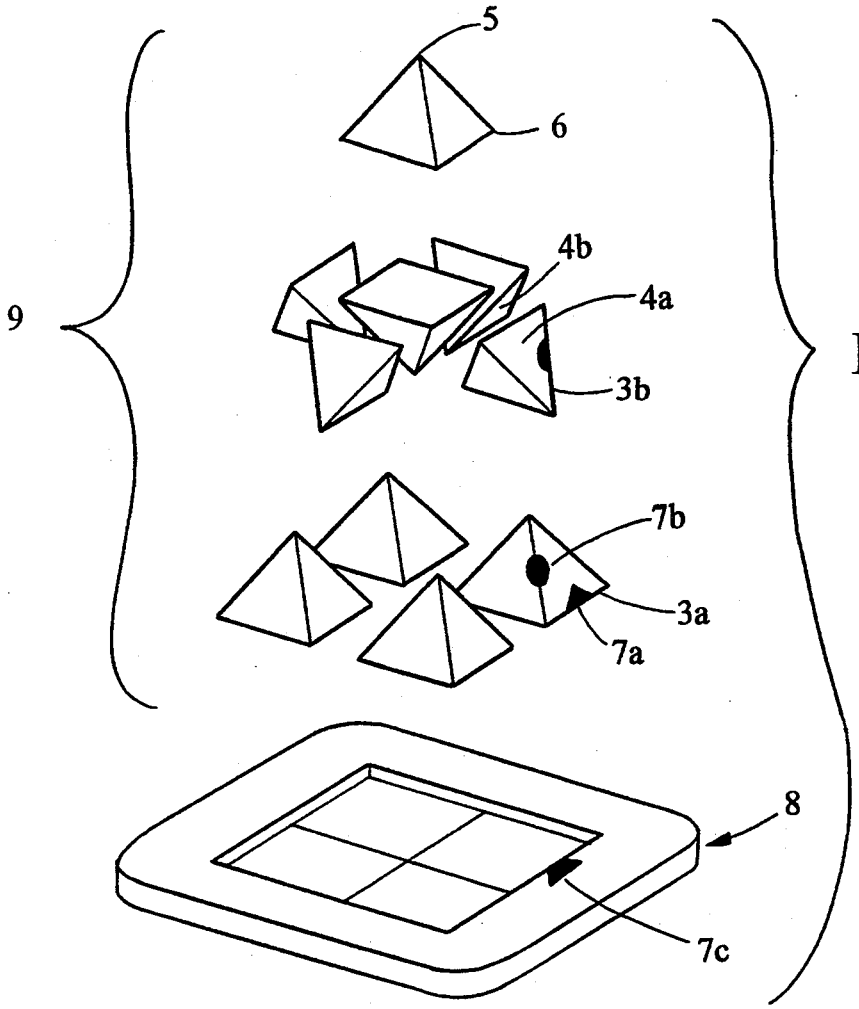
Fig 2D

Fig 5
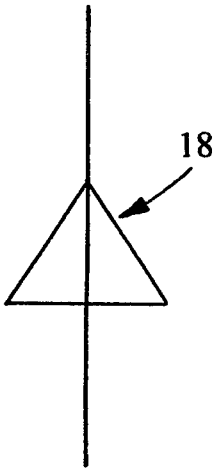
Fig 6
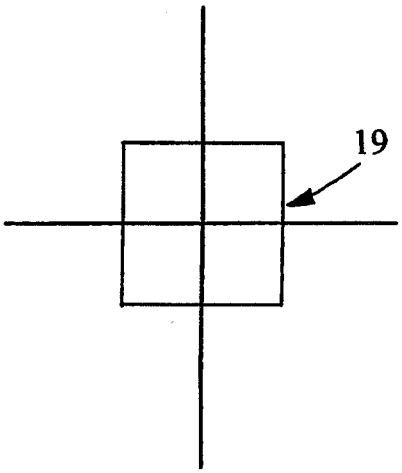
Fig 7
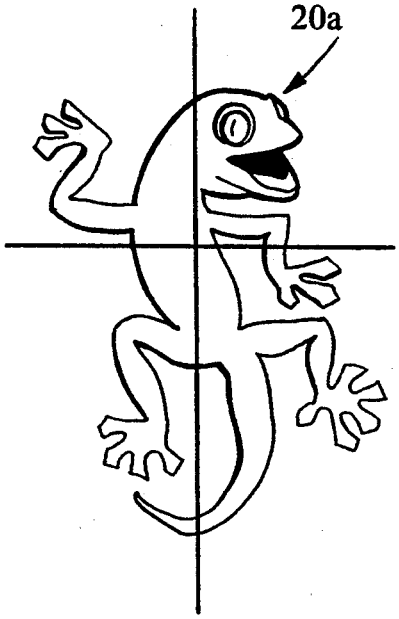
Fig 8
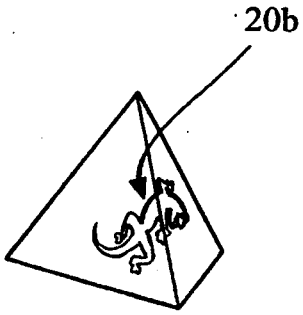
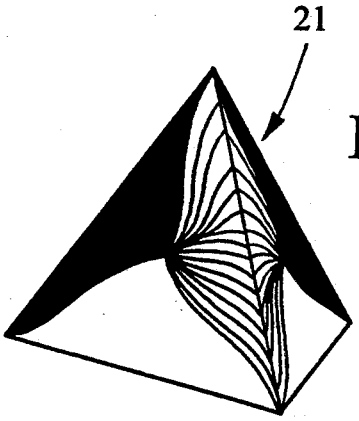
Fig 9

Fig 10A
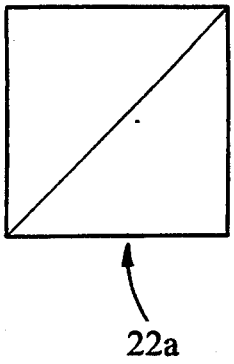
Fig 10B
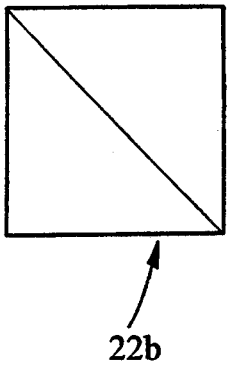
Fig 10C
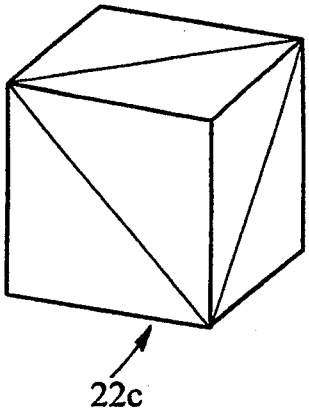
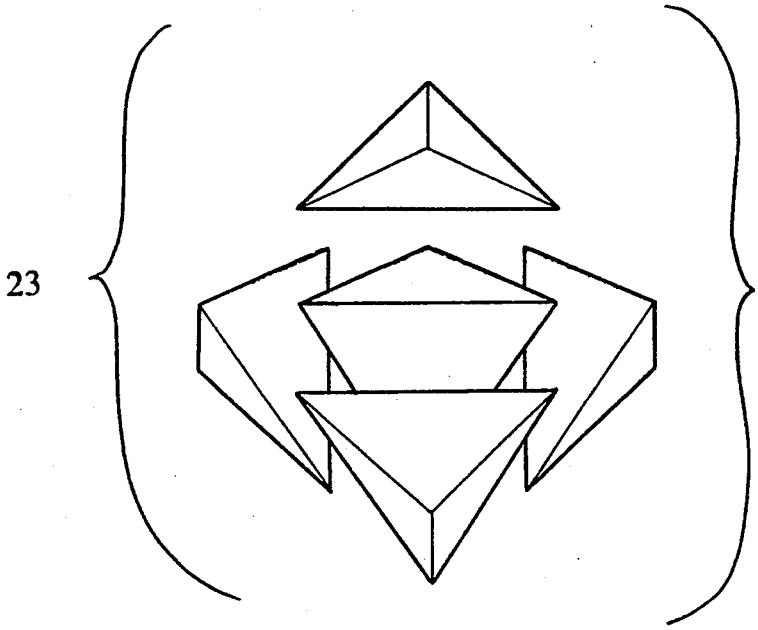
Fig 10D

Fig 11A
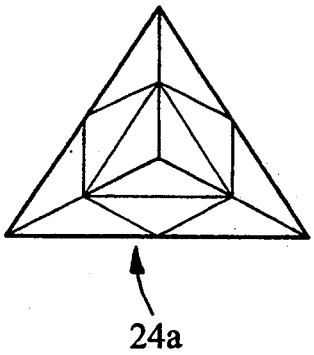
Fig 11B
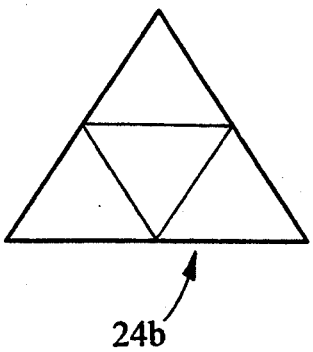
Fig 11C
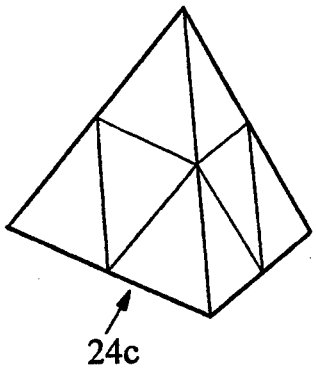
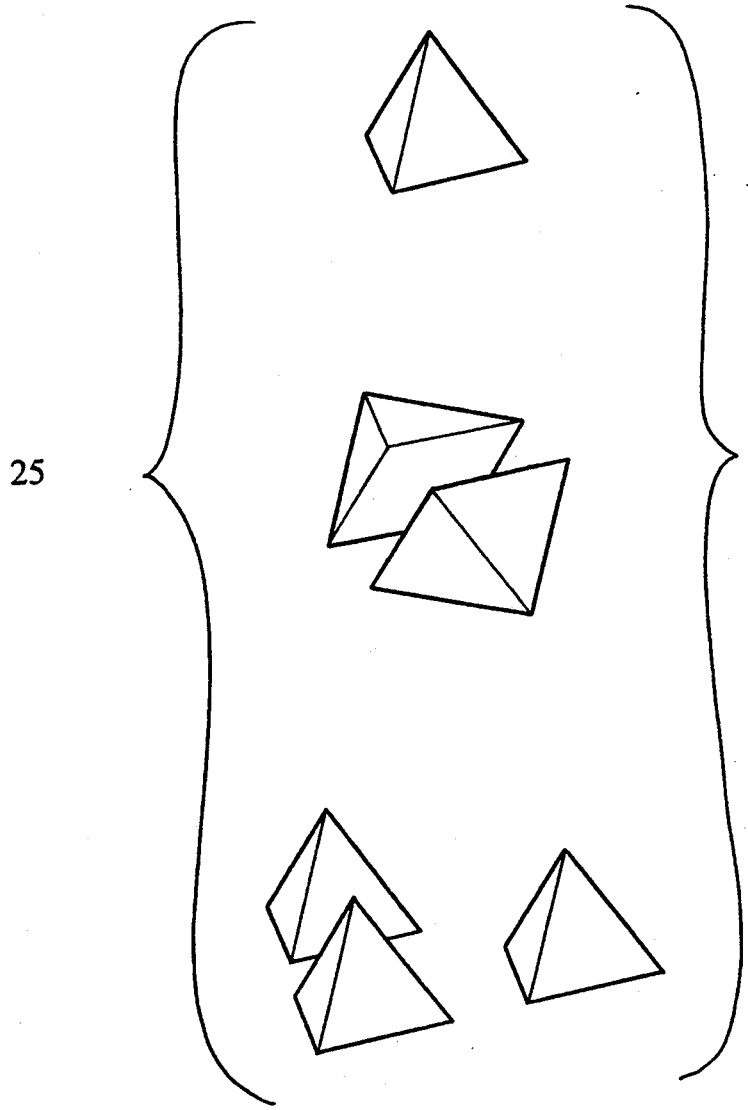
Fig 11D

Fig 12A
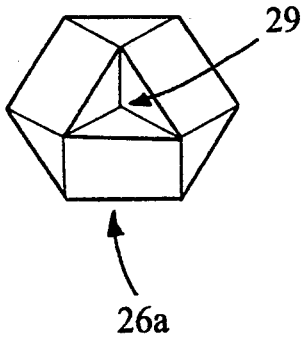
Fig 12B
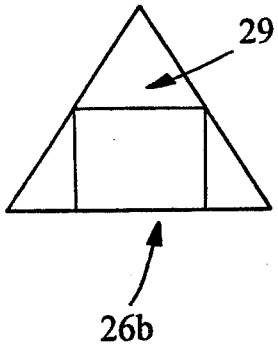
Fig 12C
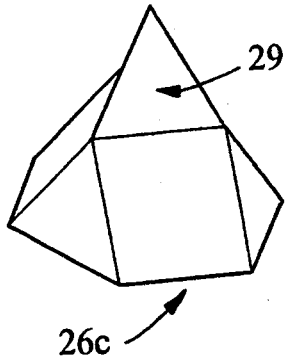
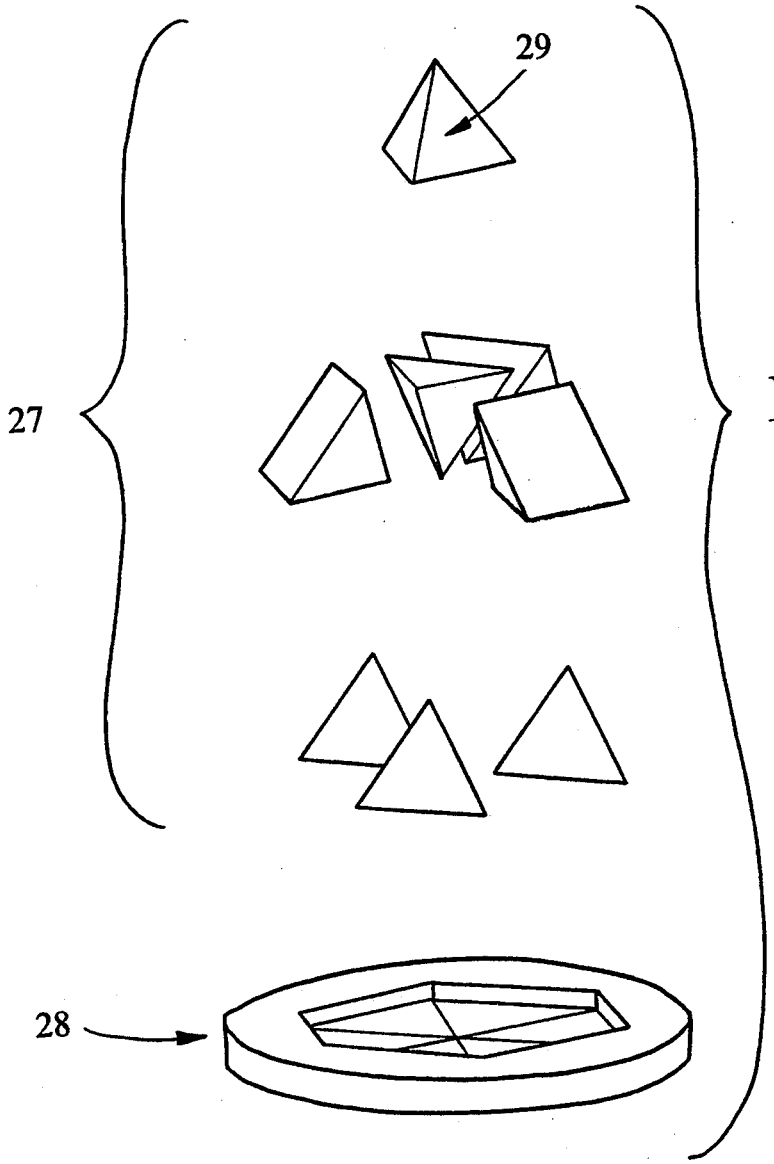
Fig 12D

Fig 13A
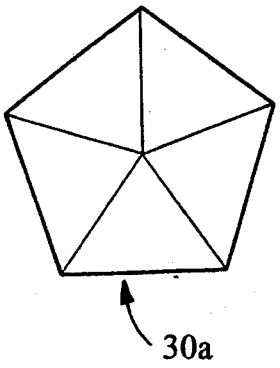
Fig 13B
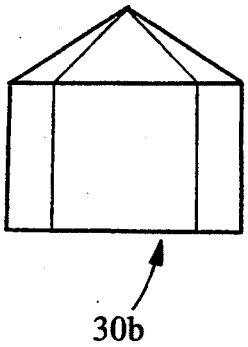
Fig 13C
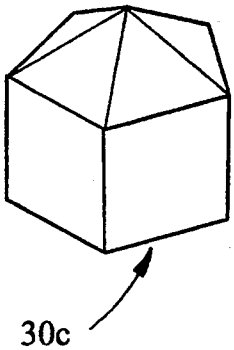
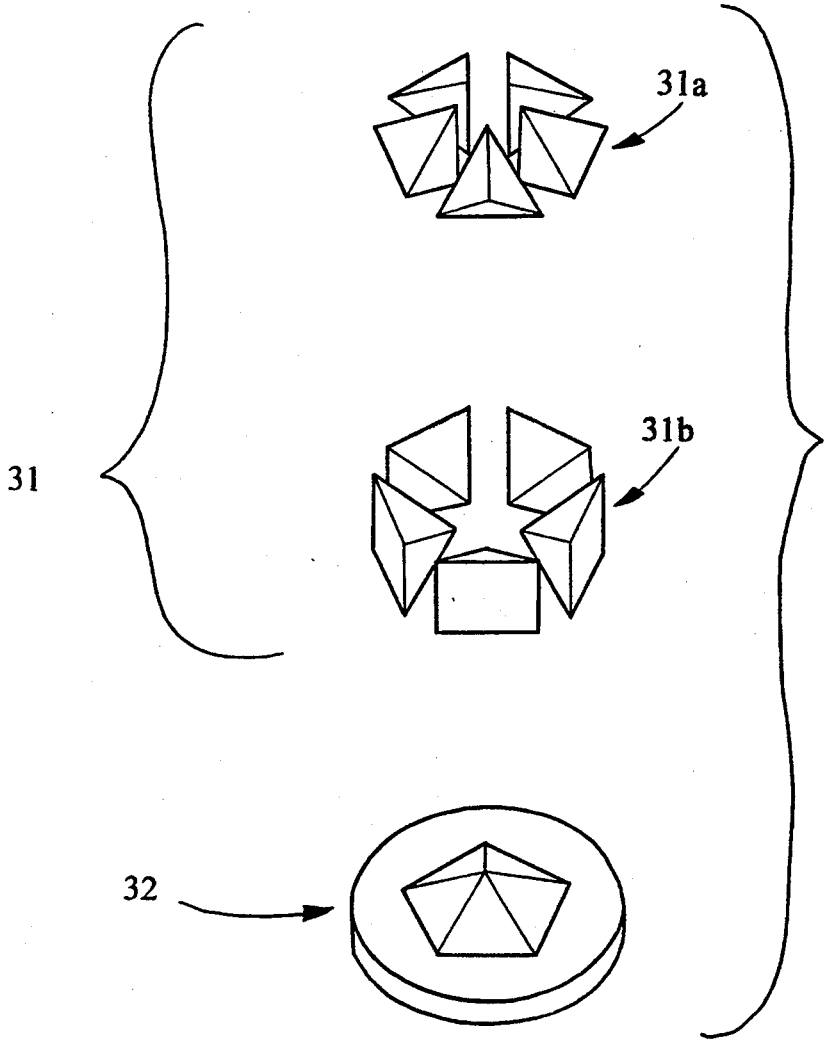
Fig 13D

Fig 14A
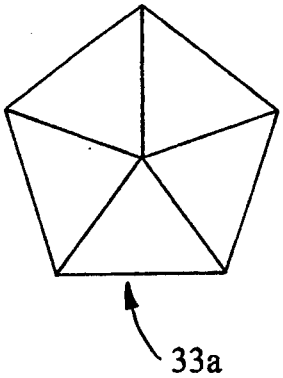
Fig 14B
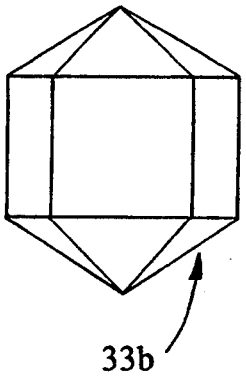
Fig 14C
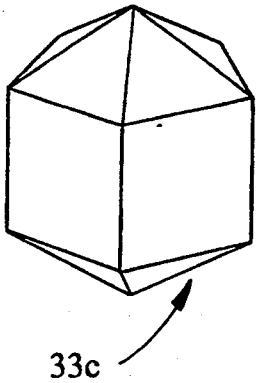
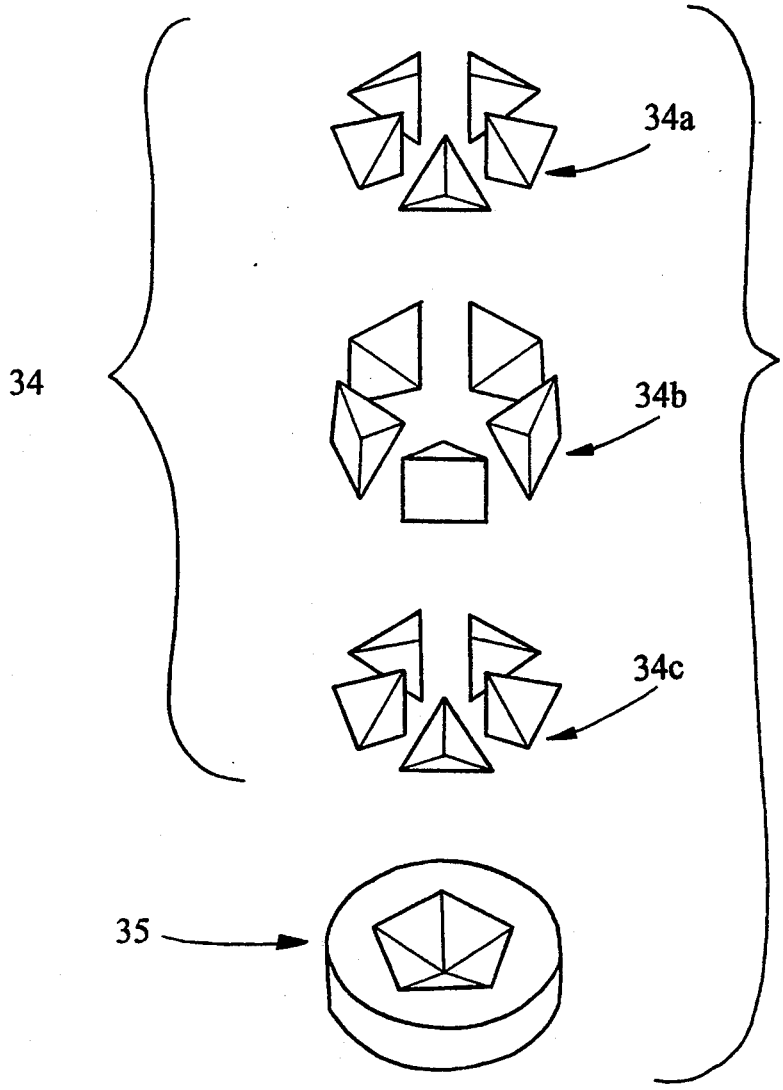
Fig 14D

Fig 15A
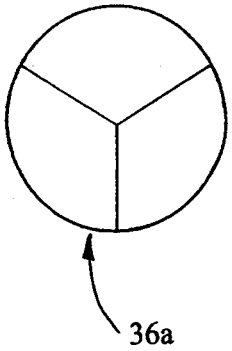
Fig 15B
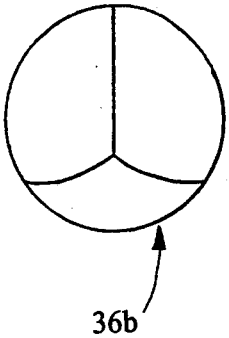
Fig 15C
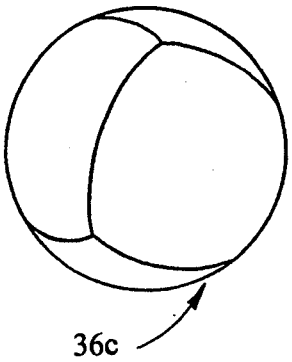
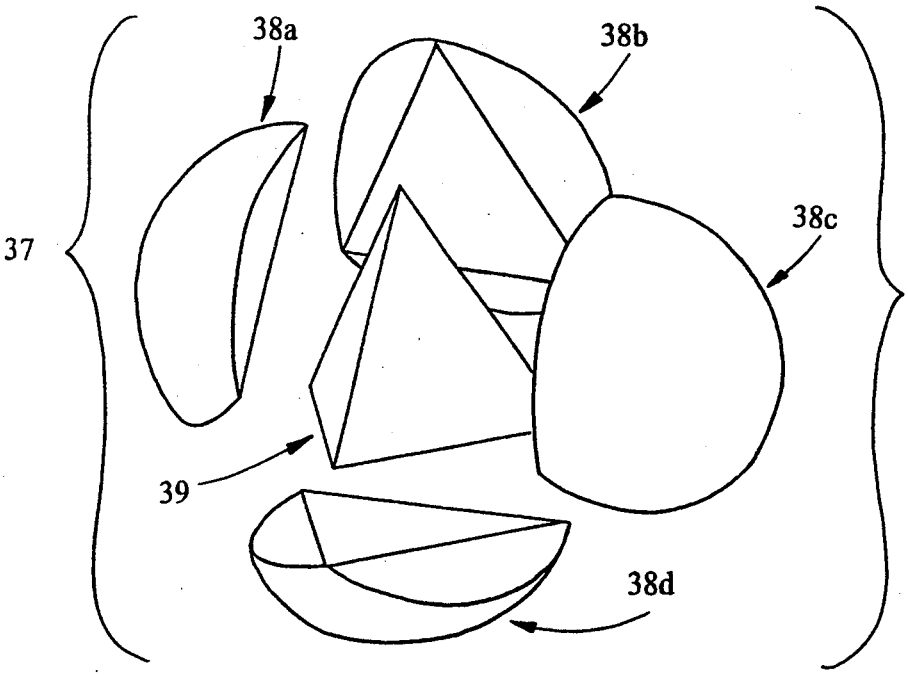
Fig 15D

EDUCATIONAL PUZZLE AND METHOD OF CONSTRUCTION

BACKGROUND OF THE INVENTION

1. Field of the Invention

This invention relates to a three-dimensional educational puzzle and the method by which it is constructed and solved. The solution relies on matching the indicia on all surfaces both exposed and non-exposed, of the playing pieces.

2. Discussion of the Prior Art

Puzzles have entertained and amused mankind for centuries. In some cases puzzles have served as educational or instructional tools in addition to entertainment. However, there have been relatively few puzzles which aid in the understanding of three dimensional geometric relationships.

Past art has described a variety of two-dimensional puzzles and games which aid in learning the relationships of similar designs, etc. on planar surfaces, such as, matching games in which images, colors, words, or etc, must be matched together to be correct or to solve a puzzle or riddle. Such puzzles and games are well described in such books as "Mathematical Magic Show by Martin Gardner (1978) and "Puzzles Old and New" by Louis Hoffman (1893)

Recently games have been conceived which rely on matching patterns on planar surfaces, for instance, Symmetrix by Ravensburger requires that players correctly match together separated images printed on playing cards. Triazzle by Dan Gilbert requires that players assemble two-dimensional triangular tiles in the form of equilateral triangles which feature separated images on each side of the triangle and when properly assembled, whole images are formed across the junction 25 of the adjoining pieces. There is no image on the non-exposed (back side) of any piece.

Neither Symmetrix, nor Triazzle are comprised of three dimensional playing pieces and do not offer the challenge of assembling a three dimensional structure nor the educational process of manipulating three dimensional structures in space. They do not require that the player understand 3-D geometrical relationships and are of little benefit in improving the coordination necessary for manipulating a three-dimensional object in space in relation to other like three-dimensional objects.

Some two-dimensional puzzles do rely on the subdivision of regular geometric shapes to produce the pieces of the puzzle, such as U.S. Pat. No. 3,637,217 However, matching of indicia on the surfaces are not required and said sub-divisions are not geometrically symmetrical. It does not aid in understanding three-dimensional geometric concepts.

Three-dimensional puzzles are known which require the assembly of smaller three-dimensional structures to form the final structure. Comprehensive books have been written which describe the variety of known three-dimensional puzzles, such as "Puzzles Old and New, How to Make and Solve Them", by J. Slocum and J. Botermans, and references therein. Most of the known puzzles do not require that designs or indicia on their surfaces be matched in order to complete the puzzle, only that the pieces be assembled to form the final structure. For example, U.S. Pat. No. 4,826,171 requires the solver to assemble the pieces such that they all fit into a prescribed pattern and assembly must be accomplished by placement of the pieces from only one direction while rotating. Thus, no three-dimensional concepts are addressed. In addition, no indicia matching is required.

Another example was described in 1970 by House of Games, Canada, which comprised a cubic puzzle composed of 13 rectangularly shaped pieces having 9 colors disposed on their surfaces. Solution of the puzzle relies on locating 9 different colors on each exposed surface of the final cubic structure. No requirement or interest was shown for the color patterns on the non-exposed surfaces.

U.S. Pat. No. 3,788,645 discloses a mathematical cube puzzle in which four separate cubes have on each of their edges one of a set of three color patterns. The object of the game is to arrange the various cubes relative to one another so that the colors associated with all exposed adjacent playing edges of different cubes match one another. This puzzle has a plurality of solutions and the pieces can be arranged into a wide variety of different shapes, few of which are symmetrical. The educational value of this puzzle is in understanding mathematical combinations but teaches nothing with respect to three dimensional geometric relationships. A number of U.S. patents have issued which describe novel three dimensional mechanical device puzzles, such as U.S. Pat. Nos. 3,637,216 and 3,655,201. These mechanical device puzzles are comprised of pieces which are permanently attached to one another and thus do not provide the solver with three-dimensional geometric concepts and spatial relationships while solving the puzzle. However they do provide the solver with the challenge of matching colors or indicia on their exposed surfaces. But, as the puzzles are attached internally, the internal surfaces are not important. A similar puzzle, also made of four cubes, called "Instant Insanity", requires matching colors on the cube faces but has only one solution which is achieved by trial and error. No logic is required to solve the puzzle and the final solution is not a true three dimensional solution. Thus, this puzzle does not provide for education in three dimensional spatial relationships.

Other three-dimensional puzzles require assembly or disassembly of the puzzle in a specific sequence. For example, U.S. Pat. No. 3,637,215 is comprised of a plurality of interlocking pieces which must be manipulated in a prescribed sequence in order to solve the puzzle. This puzzle, though providing an educational benefit for understanding binary sequence codes, does not address any geometrical concepts.

SUMMARY OF THE INVENTION

This invention comprises an educational puzzle and the method by which it is constructed and solved. It combines the requirements of assembling individual three-dimensional playing pieces into larger three-dimensional structures while matching indicia on all adjoining surfaces of the playing pieces in order to solve the puzzle. The indicia are placed on the pieces such that they overlap the edges of the pieces. Thus, only a portion of the indicia are visible when viewed perpendicularly to a given surface and, when pieces are placed adjacent to one another, the complementary portions of the indicia on separate pieces form completed indicia across the common edges of adjoining pieces. When assembled properly, any piece may be removed and the newly exposed surfaces also comprise completed indicia across the edges of all pieces. In one embodiment of the invention, the puzzle may include a base which can also have indicia or portions of indicia on its surface. The base indicia can provide additional restrictions and/or clues to the solution of the puzzle. The base may also function as a support for those structures which are not free standing by themselves. The base may be flat, concave, convex or any combination thereof, in order to match the bottom most surface of the three-dimensional structure. A particularly useful base for supporting non-free standing puzzles is one in which there is a thin ledge or depression in the base which matches the shape of the bottom most piece or pieces of the puzzle.

The puzzles can be any of a variety of shapes, but, of particular value for learning three-dimensional geometric concepts, the puzzles are preferably in the form of regular or uniform polyhedra, spheres or ellipsoids. Polyhedra in which all edges are the same length are particularly useful as educational tools, as the pieces which comprise the completed puzzle may also be regular polyhedra having limited numbers of shapes. For example, regular tetrahedra, pyramids, cubes, octahedra, dodecahedra and a variety of other polyhedra can be formed from a plurality of smaller pieces which are comprised of one or more regular polyhedral shapes. Of particular value to understanding 3-dimensional concepts are regular polyhedra which can be subdivided into smaller regular polyhedra by bisecting them with planes defined by the midpoints of all edges of the external surface. One such polyhedra is a tetrahedra which is subdivided with such planes into 10 smaller polyhedra (6 regular pyramids and 4 regular tetrahedra). The assembly and disassembly of such a polyhedra is valuable in learning the 3-dimensional spatial geometrical concepts.

Similarly, 3-dimensional polyhedra can be subdivided by planes defined by the corners of 3 or more adjacent apexes of the polyhedra. One such polyhedra is a cube which can be subdivided in this way into 4 irregular tetrahedra which circumscribe a regular tetrahedra. Again, assembly and disassembly is both entertaining and educational.

Puzzles comprised of different polyhedra circumscribing other polyhedra are particularly educational, such as the above tetrahedra, circumscribed by a cube, tetrahedra circumscribed by a sphere, and other similar combinations of circumscribed and circumscribing pieces. Solid geometric concepts and spatial relationships become readily apparent while solving these puzzles. Planning the solution of these puzzles also teaches logical thinking.

BRIEF DESCRIPTION OF THE DRAWINGS

FIGS. 2A through 2D illustrate one embodiment of the invention comprising the 10 component pieces of a tetrahedra subdivided by bisecting planes through the midpoints of all the edges of the external tetrahedryl surface, which shows the assembled and exploded views of the component pieces and includes the optional base.

FIGS. 5 through 9 provide definitions of illustrative indicia which overlay the edges of the puzzle pieces.

FIGS. 10A through 10D illustrate one embodiment of the invention comprising a 5 piece cubic puzzle comprised of 4 non-regular tetrahedra circumscribing a central regular tetrahedra, formed by bisecting the cube with planes passing through the adjacent corners of the cube, showing the assembled and exploded views of the component pieces.

FIGS. 11A through 11D illustrate one embodiment of the invention comprising 6 component pieces in a three-dimensional tetrahedryl form, showing the assembled and exploded views of the component pieces.

FIGS. 12A through 12D illustrate two embodiments of the invention comprising either 7 or 8 component pieces in a three-dimensional form having a hexagonal base, showing the assembled and exploded views of the component pieces.

FIGS. 13A through 13D illustrate one embodiment of the invention comprising 10 component pieces in a three-dimensional form, showing the assembled and exploded views of the component pieces and a base which functions to support the puzzle into a free standing form.

FIGS. 14A through 14D illustrate one embodiment of the invention comprising 15 component pieces in a three-dimensional form, showing the assembled and exploded views of the component pieces and a base which supports the puzzle into a free standing form.

FIGS. 15A through 15D illustrate one embodiment of the invention comprising 8 component pieces in a three-dimensional form in which the external pieces form a sphere which circumscribes a regular tetrahedra, showing the assembled and exploded views of the component pieces.

DETAILED DESCRIPTION OF THE PREFERRED EMBODIMENTS

Figure 1:
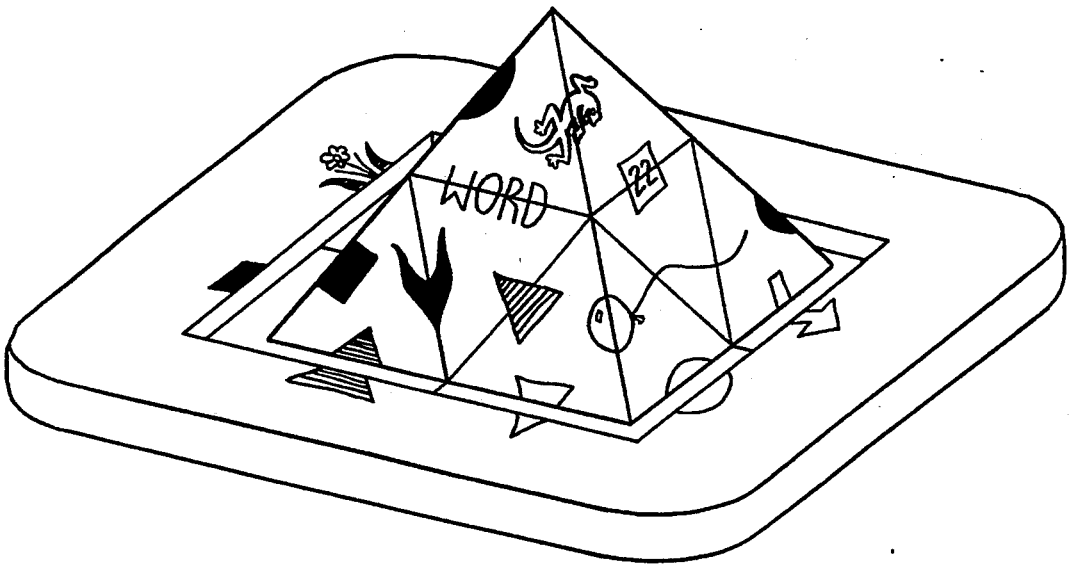
FIG. 1 is an illustration of one embodiment of the invention comprising a completed 10 piece tetrahedryl puzzle having a base and showing indicia which overlap all edges of the base and puzzle pieces in a manner such that completed indicia appear across both exposed and non-exposed faces of all adjoining pieces.
Figure 3A:
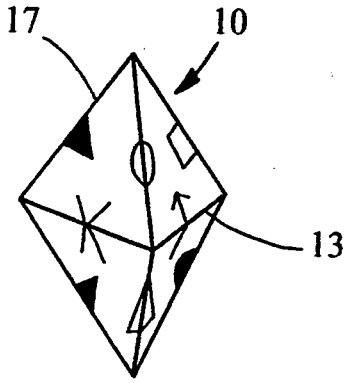
FIGS. 3A through 4B define the various constituents of illustrative puzzle pieces and show examples of the disposition of the indicia on the piece's surfaces.
Figure 4A:
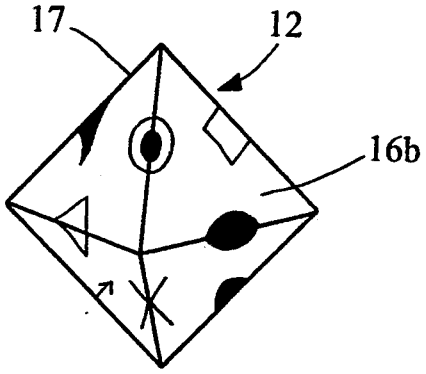
Figure 3B:
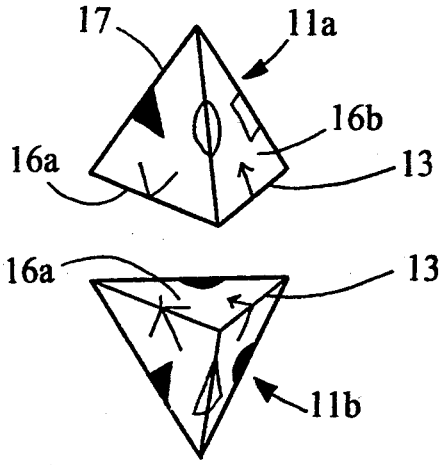
Figure 4B:
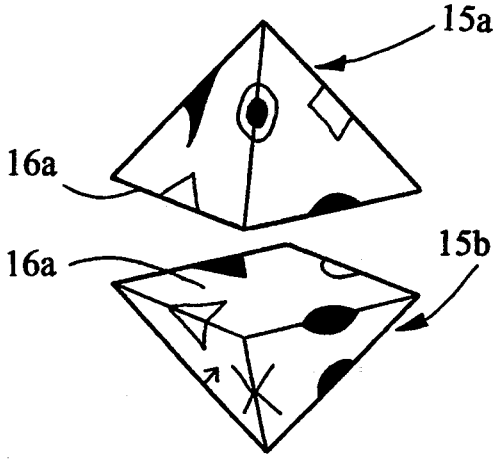

FIG. 1 is an illustration of one embodiment of this invention which consists of a three-dimensional geometric structure made up of a plurality of smaller three-dimensional structures, or pieces, that feature a plurality of indicia overlapping their edges. It shows that, when correctly assembled, completed indicia appear on all surfaces, both exposed and non-exposed, as the portion of the indicium on each piece's surface matches the complementary portion of that indicium at the adjoining piece or base surface at the intersecting edge of the adjacent pieces. To simplify the drawings in the following discussion, not all of the indicia are shown in FIGS. 2A through 2D and FIGS. 10A through 15D. In FIGS. 2A through 2D and in FIGS. 10A through 15D, it is understood that all piece and base surfaces, both exposed and non-exposed, contain indicia overlapping their edges.

FIGS. 2A through 2D describe one preferred embodiment of this invention, which comprises a three-dimensional structure like that of FIG. 1 which comprises a square based pyramid 1, divided into the three dimensional puzzle pieces of 6 smaller square based pyramids 2*a* and 4 regular tetrahedrons 2*b*. In FIGS. 2A through 2D, the relationships of the pieces are shown in assembled 1 and exploded 9 views. The assembled puzzle is shown in three views, viewed from the top 1*a*, viewed from the front 1*b*, and a perspective view 1*c*. The puzzle pieces sit in a base 8 which acts as both a foundation for the structure and a variable in the degree of difficulty of solving the puzzle. The puzzle pieces feature indicia 7*a*, 7*b*, and 7*c* which overlap the edges of the pieces and the base. Edges like 3*a* are referred to as horizontal edges, which are edges that are in contact with the square base (or face) of the upper pyramidal piece. Non-horizontal edges are referred to as leaning edges 3*b*, (such as those which connect the corners 6 of the square base with the apex 5 of the pyramids). Each piece contains faces which are either exposed 4*a* or non-exposed 4*b*, in the assembled puzzle.

FIGS. 3A through 4B show a sub-assembly of two tetrahedryl pieces 10 (comprised of pieces 11*a* and 11*b* ) and two pyramidal pieces 12 (comprised of pieces 15*a* and 15*b*). In a properly assembled puzzle, all indicia on adjacent edges 13 form completed indicia patterns across the intersections of the adjoining edges. These edges are referred to as dependent edges. Indicia on edges which are not adjacent to other piece edges are referred to as independent edges 17. Faces which contact each other in the interior portions of the completed puzzle 16a are called non-exposed faces and faces which occur on the exterior surface of the completed puzzle are called exposed faces 16*b*.

An important feature of this invention is that indicia overlap all edges of the component parts of the puzzle. However, the exact nature of the indicia is not a critical feature of the puzzle. The indicia can be of any desired shape or form. They may represent an animal, a vegetable, a word, continuous lines, a picture, etc. or may be geometric patterns of different colors. FIGS. 5 through 9 show that the indicia can be symmetrical about one axis 18, symmetrical about two axes 19, or asymmetrical 20*a*. They may cover only a portion of the face as in 20*b* or the entire face, as in 21. If the indicia are asymmetrical, their orientation relative to one another is an important feature of the puzzle as will be discussed later.

The object of the puzzle is to build the structure from the puzzle pieces in such a way that all of the exposed and non-exposed faces, exhibit completed indicia composed of the complementary portions of the same indicia overlapping the edges of the adjoining puzzle pieces. An illustration of a solution to a puzzle such as the 10 piece pyramidal puzzle of FIGS. 1 and 2A through 2D consists of the following steps. Identify the pyramidal pieces of the puzzle which have complementary halves of the indicia on the base, and which when properly oriented with one another form completed indicia between the base and the bottom edges of all pieces and between the bottom edges all adjoining pieces. This leaves two pyramidal pieces which will be needed to complete the puzzle in the final step. Having assembled the first four pyramidal pieces on the base, the four tetrahedryl pieces are then oriented in such a way as to fill the void spaces between the pyramidal pieces while matching the complementary indicia on all exposed and unexposed faces of the puzzle. When this is completed, the square faces of the two remaining pyramidal are placed together in such a manner as to match the complementary indicia on all of their adjoining edges, thus forming a regular octahedryl geometric shape. The two assembled pyramidal pieces are then placed on and within the previously assembled pieces in such a manner that all of the indicia of all pieces form completed patterns on all exposed and unexposed faces. Using a similar method of solution, the puzzles shown in FIGS. 10A through 15D can also be constructed.

FIGS. 10A through 10D illustrate a 5 piece cubic puzzle in assembled 22 and exploded 23 views. The assembled puzzle is shown in top 22*a*, front 22*b*, and perspective 22*c* views. It is comprised of four irregular tetrahedra which circumscribe a regular tetrahedron.

FIGS. 11A through 11D illustrate a 6 piece tetrahedryl puzzle in assembled 24 and exploded 25 views. The assembled 5 piece puzzle is shown in top 24*a*, front 24*b* and perspective 24*c* views.

FIGS. 12A through 12D illustrate an 8 piece puzzle in assembled 26 and exploded 27 views and having a hexagonal base 28. The assembled puzzle is show in top 26*a*, front 26*b* and perspective 26*c* views. The 8 piece puzzle comprises 3 pyramidal pieces and 4 tetrahedryl pieces on the bottom layer, in contact with the base, and a tetrahedryl piece on top 29. These figures also illustrate a 7 piece puzzle which comprises only the bottom layer pieces and the base and piece 29 is not included.

FIGS. 13A through 13D illustrate assembled 30 and exploded 31 views of a 10 piece, "Gazebo" shaped puzzle, having a base 32 which is required to support the assembled pieces, which would not otherwise be free standing. The assembled puzzle is shown front top 30*a*, front 30*b* and perspective 30*c* views. The assembled 10 piece puzzle, is comprised of five tetrahedra placed together to form the top layer 31*a* and five pyramidal pieces placed together, as in 31*b* to form a middle layer. This 10 piece puzzle has a concave raised portion in the base 32 to accommodate the bottom layer of pyramidal pieces 31*b*.

FIGS. 14A through 14D illustrate assembled 33 and exploded 34 views of a 15 piece, "Chinese Lantern" shaped puzzle, having a base 35 which is required to support the assembled pieces, which would not otherwise be free standing. The assembled puzzle is shown in top 33*a*, front 33*b*, and perspective 33*c* views. The assembled 15 piece puzzle 33, is comprised of five tetrahedra placed together to form the top layer 34*a*, five pyramidal pieces placed together, as in 34*b* to form a middle layer and another five tetrahedra placed together to form a bottom layer 34*c*. The base for the 15 piece puzzle contains a concave depression to accommodate the bottom layer of the puzzle 34*c*.

FIGS. 15 A through 15D illustrate a spherical puzzle in assembled 36 and exploded 37 views. The assembled puzzle is shown in top 36*a*, front 36*b* and perspective 36*c*, views. This puzzle is comprised of four exterior pieces 38*a*–38*d* which circumscribe a regular tetrahedra 39.

To make a puzzle which can be assembled, having all of the features described above, it is necessary not only to have the correct number and geometric shapes of the pieces, but it is also essential to have the indicia which overlap the edges of the pieces arranged in proper sequence and orientation on all pieces of the puzzle, as illustrated in FIG. 1. The degree of difficulty in solving the puzzle is a function of the number of different indicia which overlap the edges of the pieces and their orientation with respect to one another in the completed puzzle.

An example of a 10 piece pyramidal puzzle which presents a low degree of difficulty is one in which only one indicia design is present on the edges of all pieces of the puzzle and the only variability is the orientation of the indicia on the edges. The base contains all indicia in the same orientation (eg. head pointing in). All pyramidal pieces are identical and all tetrahedryl pieces are identical. The edges of the base pyramidal pieces contain three indicia facing in the same direction and remaining indicia faces the other direction. Thus, the solution requires only that the odd indicia be placed in the interior edges of the bottom pyramidal pieces to complete the correct pattern, as all of the exterior edges will match the complementary portion of the indicia on the base. Completion requires that the tetrahedryl and two remaining pyramidal pieces be assembled as described above. Another example of a low degree of difficulty puzzle is one in which there are as many different indicia as there are intersecting faces. Once the base patterns are matched each subsequent piece is easily assembled.

Thus, low difficulty is associated with either very few or very many indicia on the edges of the puzzle pieces. Higher difficulty is a achieved by intermediate numbers of indicia. For example, a puzzle of moderate difficulty would be the 10 piece puzzle, shown in FIGS. 1 and 2A through 2D, containing six different indicia. Optimizing the number of indicia makes the puzzle both challenging while not being so difficult that it discourages the solver. The procedure for selection of the appropriate number of different indicia is discussed later in the disclosure.

The complexity of the puzzle also depends on the orientation of indicia on the pieces and on the number of repetitions of a given indicia sequence on the puzzle faces. The more repetitions, the more chances that the solver will place the wrong piece in a given location and the more difficult the puzzle will be to solve.

To construct a puzzle, one could make the appropriate number of indicia and begin by placing the indicia on the base. Then, by matching the complementary portions of the indicia on the horizontal edges of the bottom pyramidal pieces (as in the puzzles of FIGS. 1 and 2A through 2D), the bottom layer of designs can be constructed. Indicia are then placed on the leaning edges of the assembled pyramidal pieces and the matching faces of the tetrahedryl are constructed by placing the appropriate complementary indicia on them. Indicia are then added to the remaining horizontal edge of the assembled tetrahedryl pieces.

The remaining two pyramidal pieces are then constructed in a like manner by matching the complementary portions of the indicia exposed in the partially assembled puzzle. The final indicia are added to the top most leaning edges of the last pyramidal piece to complete the puzzle. This procedure can be done by random selection and placement of the indicia or it can be done in a systematic or semi-systematic fashion. One particularly desirable puzzle is constructed as follows using, as an example, the puzzle illustrated in FIGS. 1 and 2A through 2D. This puzzle is comprised of ten pieces, six of which are pyramidal and four of which are tetrahedryl. The pyramidal pieces are comprised of five sides or faces, one side being a square and the other faces being equilateral triangles. The tetrahedra are comprised of four sides or faces, each of which is an equilateral triangle of the same size as the triangular faces of the pyramids.

It will be noted that there are a number of edges which do not overlap any other edges in the completed puzzle. These are called independent edges. All other edges are interdependent in that their indicia must match, in a complementary fashion, the indicia on the edges to which they are adjacent. These indicia can be envisioned as primary and secondary dependent edges. Primary dependent indicia are defined as those on which one can place indicia with no restriction. Once the primary indicia are placed the secondary dependent edges and indicia thereon must be placed such that they match in a complementary way the edge indicia of the primary dependent edge indicia. Thus, one can determine the maximum number of unique indicia which may be placed on the edges of a given puzzle by summing the number of independent and primary dependent edges of the base.

Figure 16:
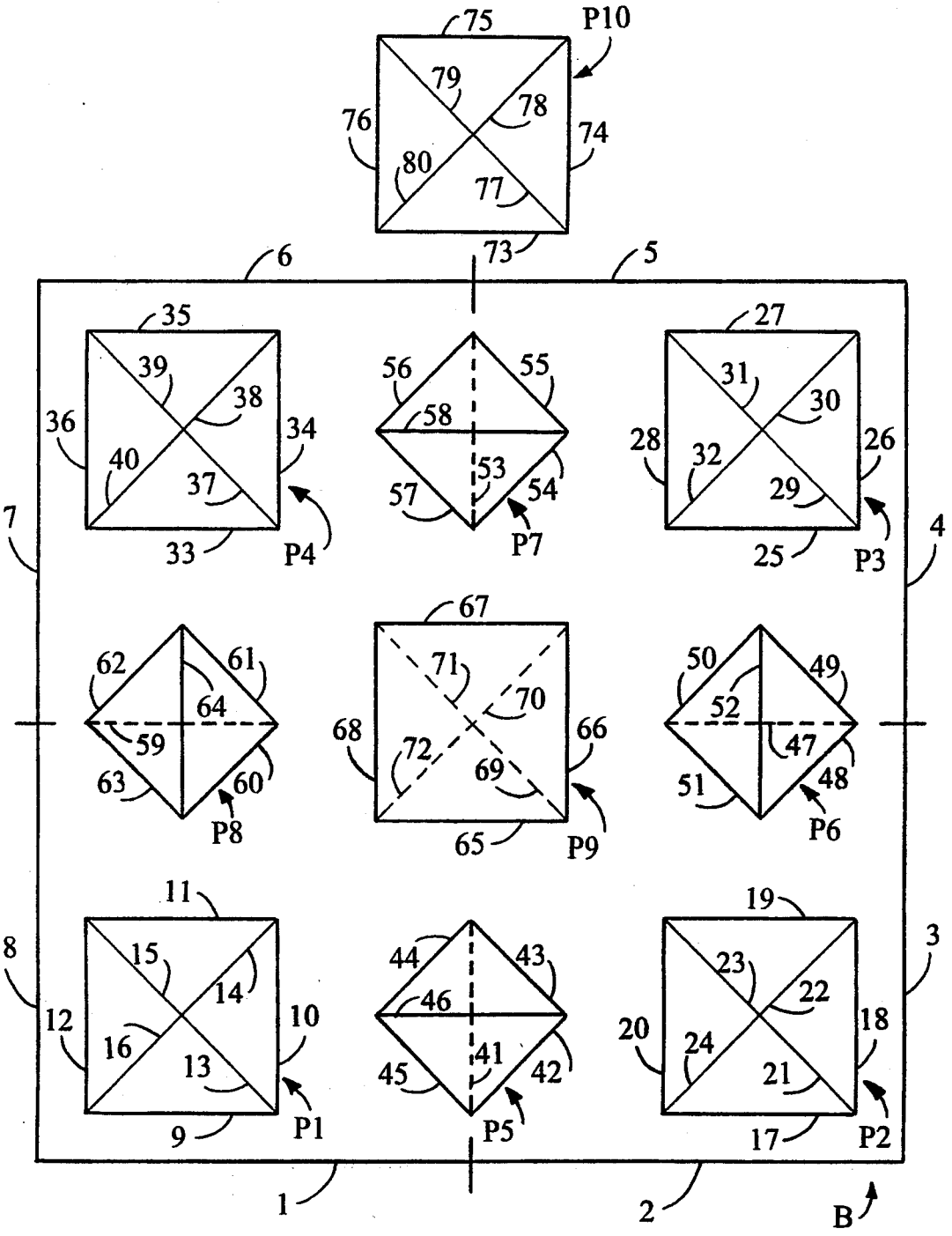
FIG. 16 is an illustration of the piece and edge definitions for a puzzle similar to that of FIG. 1 on which the indicia are placed in a systematic manner to produce a solvable puzzle having the characteristics of the scope of the invention herein.

As illustrated in FIG. 16, this pyramidal puzzle, composed of 10 pieces and a base has 80 potential edges which may or may not occur adjacent to one another. In fact there are only 36 edges which are unique. All other edges are dependent on the particular indicia pattern and orientation of these 36 edges.

For a puzzle to be of moderate difficulty, it is desirable to have a multiplicity of indicia yet limit their number so as not to be excessive. It has been found that a desirable number of indicia for a moderately difficult puzzle can be defined by first determining the number of unique edges of the puzzle pieces (36 edges in the illustrations of the puzzle in FIGS. 2A through 2D). The number of indicia are then selected such that the total number of different indicia lies between $\frac{1}{3}$ and 1/12 of the total number of unique edges; preferably between $\frac{1}{4}$ and $\frac{1}{8}$ of the number of unique edges. In the illustrations of FIGS. 2A through 2D, 6 different indicia are preferred, or 1/6 of the number of unique edges. It will thus, be both challenging to the solver, yet not so difficult as to be discouraging. These indicia can be any shape or size so as to be pleasing in appearance. They can relate a common or different theme. One example is of a common theme is a puzzle in which the indicia are illustrations of animals, such as geckos. These indicia, being geckos, are asymmetrical at least along one axis and can thus be thought of as having a head and a tail. Thus, the geckos can be placed on the edge of the puzzle pieces such that the head lies on one face and the tail lies on the adjoining face of the edge over which the gecko is placed. Of course, the geckos can be placed over the edges such that they face in a parallel direction to the edge and they may be have fight and left sides which are either symmetrical or asymmetrical.

For ease of designing and constructing a puzzle of the type described herein, it has been found that assigning standard numbers to the pieces and all of the edges of the pieces and the base, provides a logical means to creating a solvable puzzle. FIG. 16 illustrates the assignment of numbers to the pieces and their corresponding edges for a puzzle such as that in FIGS. 1 and 2A through 2D. Similarly FIG. 17 defines the piece and edge numbers on an alternate arrangement of the two central pyramidal pieces of a 10 piece pyramidal puzzle. FIG. 18 in a similar way defines the pieces and edge numbers for a 6 piece tetrahedryl puzzle similar to that of FIGS. 11A through 11D. The following disclosure describes the procedure by which one assigns the piece and edge numbers in such puzzles. Using this procedure, anyone skilled in the art can proceed to design a puzzle of any geometric shape, having any number of pieces and any number of different indicia in a variety of orientations.

For illustration, the indicia, can be represented as six different patterns which can be referred to in shorthand notation as A,B,C,D,E and F. A systematic puzzle is constricted such that the square faces of all six pyramidal pieces contain only four of the six patterns. In addition, orientation of the patterns is such that, the line connecting the head and tail of the pattern is perpendicular to the edge, which the pattern overlaps. Thus, viewing the pyramidal pieces, as in FIGS. 15A through 15D, from the apex toward the square face, one sees four complete indicia oriented parallel with the edges of the square face and four half indicia oriented perpendicular to the same edges which they overlap.

For clarity, puzzle edges will be described according to the convention shown in FIG. 16. In this FIG., the base is B and pieces 1–10 are P1–P10. The edges are numbered 1–80, as shown in FIG. 16 Base edges are assigned the lowest numbers, then those of P1, then P2, etc. Dashed lines represent hidden edges. This numbering convention is also used in FIGS. 17 and 18.

The disposition of the pieces in FIG. 16 is the same as that shown three dimensionally in FIGS. 2A through 2D. Thus, pieces 1–4 constitute the bottom layer of pyramidal pieces which rest on the base. Pieces 5–8 are tetrahedryl pieces which rest within the leaning faces of pieces 1 through 4 and they constitute the second layer of assembly. Pieces 9 and 10 are the remaining pyramidal pieces which rest within the leaning faces of assembled pieces 5–8 and also form the top piece or apex of the puzzle.

In placing the six patterns on these pieces, the sequential order of the pattern placement on the faces, can be varied in a systematic fashion, such as clockwise, counterclockwise, alternating, etc. The direction of the patterns can also be oriented in a systematic fashion as well, such as all heads pointing toward the apex, alternating heads and tails, etc.

To construct the puzzle one can start with the base and impress the indicia on outer edges of the base in a regular pattern in which only three of the six indicia are placed on the outer edges of the base and the order of the indicia placement, in a counterclockwise direction, is B,D,C,C,D,B,C,C. In addition the orientation of these indicia, relative to the apex, is such that the head points either inward (toward the apex) or outward. Thus, the orientation can follow a regular sequence, relative to the outside edge, such as head, head, tail, head, tail, tail, head, tail, etc.

There are several shorthand notations that can be used to describe such sequences. For example, by underlining the letter, one can describe that its orientation is such that the tail points toward the apex or could be assigned a negative value. Thus, the base indicia sequence and orientation can be described as follows: $\underline{B},\underline{D}$, $C,\underline{C},D,B,\underline{C},C$. Similarly, when viewing the piece from above, with the piece oriented in its correct configuration in the completed puzzle, if the indicia points clockwise it can be assigned a negative value and the shorthand notation letter would be underlined. With this notation one can completely describe each piece of the puzzle but it has been found that such descriptions are rather cumbersome.

A preferred method of description is one in which the puzzle edges are listed in a vertical column and the indicia associated with them are listed adjacent to the edge number along with the sign of the indicia indicating its orientation in the completed puzzle. Thus, the edges of the puzzles of FIGS. 1 and 2A through 2D are defined in FIG. 16. A column of 80 numbers can describe the puzzle edges and the letters A,B, C,D,E, and F can represent the desired indicia. A convention, specific for a given puzzle, is then decided upon and +or− is placed adjacent to the indicia letter. Examples 1–4 show complete descriptions of four different puzzles which are solvable and are illustrative of the invention described herein.

It should be kept in mind that, depending on that particular puzzle, many of the edges are dependent on others and that assignment of an indicia and its orientation dictates that the other dependent edges which adjoin that edge must have the same indicia and its orientation must be such that, when the pieces are assembled in the completed puzzle, one will observe completed indicia designs on all faces at all levels of puzzle assembly or disassembly. A convenient method for assignment of indicia numbers and orientations is to start with the base.

As an illustration, assignment of indicia to the puzzle of FIG. 16 is described below and in Example 1. The base edge indicia (1–8) are assigned first. The first layer of pyramidal pieces (P1–P4 of FIG. 16) are then assigned such that the halves of the indicia on their square bottom edges which are adjacent to the base indicia, when viewed from the apex, are the complementary halves of the indicia on the base. Thus, when viewed from above, one observes completed indicia around the entire perimeter of the puzzle.

The interior bottom edges of the first layer of pyramidal pieces are then assigned such that, when viewed from above, completed indicia are seen on the four inner edges of the adjoining pieces also form completed indicia from complementary halves of indicia on the two adjoining pieces (as shown in Example 1).

A particularly desirable sequence of indicia on the square faces of the pyramidal pieces involves only four of the six indicia following the sequence A,B,C,D in either a clockwise or counterclockwise direction. For a moderately difficult puzzle, three of the pyramidal pieces have indicia rotating in a clockwise direction and three rotate in a counterclockwise direction. Thus, more than one piece, when placed in the same location, can form a completed indicia patterns with the adjoining pieces and/or the base. In some instances, one may wish to construct pyramidal pieces 1 through 4 first, and then design the base to match the indicia of the outer edges of the assembled four pyramidal pieces.

Having completed the assignment of indicia on the bottom edges of the square faces of pieces 1 through 4, the leaning edge indicia are then designed. A desirable configuration of the indicia on the leaning edges of these pieces form patterns of completed indicia which all rotate in a counterclockwise direction. In underlined notation, by convention, if the indicia face in a clockwise direction the letter is underlined and if it faces counterclockwise it is not underlined.

Thus, in shorthand notation the sequence and orientation of the indicia on the leaning edges of pieces 1 through 4 are as follows: piece 1-E,C,D,F; piece 2-D,F,E,C; piece 3-F,E,C,D; piece 4-C,D,F,E. None of the letters are underlined in this example as they all are oriented in a counterclockwise direction.

As described above, the next layer of pieces (tetrahedryl pieces 5 through 8) are constructed such that the indicia of pieces 5 through 8 contain the complementary halves of indicia of the leaning edges of pieces 1 through 4 which they contact in the assembled puzzle. Thus, five of the six indicia on the edges of pieces 5 through 8 are dictated by the indicia previously placed on the leaning edges of pieces 1 through 4. In addition, as described previously, pieces 9 and 10 contain on their square faces indicia A,B,C,D in clockwise and counterclockwise sequence so as to provide a certain degree of difficulty to the puzzle. Thus, the remaining edge of pieces 5 through 8 must comprise indicia A,B, C and D in order to match the complementary halves of the indicia on the square faces of pieces 9 and 10.

To complete the construction of the puzzle, pieces 9 and 10 are then finalized. As described above, the sequence and orientation of the edges of the square faces of pieces 9 and 10 were constructed earlier to adjust the difficulty of the puzzle. The remaining indicia on the leaning edges of piece 9 are defined by the fact that they must provide the complementary halves of the indicia of the open faces of pieces 5 through 8 in the partially assembled puzzle. Piece 10 then, has four unassigned indicia on its leaning edges, which can be chosen to provide a puzzle of varying degrees of difficulty. If the sequence and orientation matches that of another piece, the puzzle is more difficult, as duplication provides confusion to the solver. If the sequence and orientation is unique the puzzle becomes less difficult to solve, as that piece can be more easily distinguished from the other five pyramidal pieces at the start of the assembly of the puzzle. Example 1 provides an illustration of such assignments.

In the example described above, pieces 9 and 10 can be assembled separately by placing their square faces together in proper orientation, forming an octahedryl geometric shape. This octahedron can then be placed in the open depression of assembled pieces 1 through 8, if properly oriented with the indicia of the open faces of pieces 5 through 8. In the example described above, the square faces of pieces 9 and 10 lie horizontally, or parallel with the base of the puzzle. An alternative puzzle is one in which the octahedron of assembled pieces 9 and 10 is rotated 90 degrees such that the square faces of pieces 9 and 10 lie perpendicular to the base of the puzzle. In such a puzzle, the indicia would of course occur in different sequences and orientations from those in the puzzle described previously. This puzzle, having rotated pieces 9 and 10, is slightly more difficult than the previously described puzzle. One example of a completely constructed puzzle having rotated pieces is described in Example 2.

As can be seen from the above discussion, a puzzle can be designed in a logical manner, following a set of rules, such that a solvable puzzle can be generated with any desired degree of difficulty. For ease of design, the total number edges on all of the pieces and the base are determined and listed in a column. The edges of each piece of the puzzle and the base are then assigned. The number of unique edges are then identified and the dependent edges for each of the unique edges are then identified and listed beside the unique edge to which they correspond on the previous columnar list of numbered edges.

Using similar logic to that described above, anyone skilled in the art can construct other puzzles having the same geometric shape as that in FIGS. 1 and 2A through 2D and Examples 1 and 2 but having indicia of different designs or sequences or orientations of indicia on the pieces and it is understood that such other puzzles are within the scope of this invention. In a similar manner, puzzles of different geometric shapes, such as those described in FIGS. 10A through 15D, having the same or different indicia in different orientations and sequences also fall within the scope of this invention. Likewise, anyone skilled in the art can construct puzzles of other geometries using the procedures described in this disclosure. Therefor, such puzzles of different geometries, having indicia on their edges, which must be matched with the indicia of adjoining pieces, in the assembled puzzle, also will fall within the scope of this invention.

It is understood that the material of construction of the puzzles described herein is not critical to the spirit of the invention. The pieces can be solid or hollow. They may be constructed of any suitable material, such as wood, plastic, paper, ceramic, etc. They may be constructed of sheets of paper or cardboard in which the indicia have been printed and then folded into the desired geometric shape or they may be molded into the desired shape and indicia impressed on their edges. Any convenient means of fabrication can be used and still fall within the scope of this invention.

The foregoing is considered as illustrative only of the principles of the invention. Further, since numerous modifications and changes will be readily apparent to those skilled in the art, it is not desired to limit the invention to the exact shapes, configurations or designs described in the drawings. Accordingly, all equivalents, modifications, and derivatives, which may be envisioned by those skilled in the art, fall within the scope of this invention.

EXAMPLE 1

10 PIECE PYRAMIDAL PUZZLE

This puzzle has a pyramidal shape composed of 10 pieces. There are 6 smaller pyramids, 4 tetrahedra and a base. There are 80 edges which overlap (36 are unique). The edges are numbered sequentially on the pieces placed in their normal configurations in the assembled puzzle (see FIG. 16). Starting with piece 1 placed on the base in the 7:30 position of a clock face when viewing the puzzle from above. By convention edges 1 and 2 form the reference line for assigning numbers to the edges. Edges 1–8 on the base, are numbered on the base in counter clockwise direction starting with the let most corner.

The bottom pyramidal pieces are assigned numbers 1–4. The other two pyramidal pieces are 9 and 10 with 9 being the inverted piece of the assembled puzzle. The assembled puzzle has pieces 1–4 placed on the base in a counter clockwise direction starting with piece 1 at edge 1 of the base. The edges of pieces 1–4 are similarly assigned numbers in a counter clockwise direction. The leaning edges are numbered, starting with the right most edge closest to the reference base edge (1 and 2). The square base edges are numbered first. Thus, the edge numbers of the pyramidal pieces 1,2,3,4 and 10 are: piece 1=edges 9–16, piece 2=17–24, piece 3=25–32, piece 4=33–40, and piece 10=73–80. Piece 10 is numbered in its inverted position (apex pointing down) and contains edges 65–72.

Tetrahedryl pieces are assigned in counter clockwise direction starting with the piece closest to the reference base edges (1 and 2). Thus, the tetrahedryl pieces represent pieces 5–8. The tetrahedryl pieces edges are similarly numbered in their correct orientation in the assembled puzzle. By definition, the first edge is the bottom edge, which contacts the intersection of adjoining bottom pyramidal pieces the last edge is the top edge which touches the apexes of the bottom pyramidal pieces. The four leaning edges of the tetrahedra which adjoin the leaning edges of the bottom pyramidal pieces, are numbered in a counter clockwise direction, starting with the right most edge. Thus, the corresponding edges of the tetrahedryl pieces are: piece 5=edges 41–46, piece 6=47–52, piece 7=53–58, and piece 8=59–64.

By convention, indicia which point toward the apex of tetrahedryl pieces are assigned +1. Indicia which point toward the pyramidal base are assigned −1. On the leaning edges, of the pyramidal pieces, a counterclockwise orientation is assigned a +1. The tetrahedryl piece indicia are assigned while viewing the tetrahedryl pieces in their proper locations in the assembled puzzle. That is, the pieces are situated such that one edge is parallel with the plane of the base. This edge is the bottom edge of the piece and is oriented so that it is perpendicular to the base edge it touches in the assembled puzzle. Viewing each piece from the center of the puzzle, down the line of the bottom edge, if the bottom edge indicia points toward the left it is +1. If the indicia on the top edge points away from the center of the puzzle, it is assigned −1. The other indicia are assigned +1 if they are oriented in a counterclockwise direction.

Pieces 9 and 10 are oriented, by convention, such that, in the assembled puzzle, the first square edge of each piece (piece 9=65 and piece 10=73) are on the same side as the reference line (edges 1 and 2).

With tiffs convention one can determine which edges are interdependent and which signs they must have to be complementary with the adjacent edges of adjoining pieces. For example edge 16 is independent, edges 7 and 36 are interdependent as are edges 14,44,60 and 72. To assign indicia and orientations (signs) to the 80 edges of this puzzle, the edge numbers are listed 1–80 and assignments are begun with the base then piece 1, then 2 etc. As assignments are made, the dependent edges which are affected are noted and are also assigned, so that the final puzzle will solvable.

For a 10 piece pyramidal puzzle of this configuration, the dependent edges are identified below. In this illustration, o means an independent edge and assignment is not critical, * means previously assigned as a dependent edge. A positive orientation is assigned by convention as the first assignment on primary dependent edges and on independent edges. Negative orientations (−) are assigned to all secondary dependent edges which adjoin primary dependent edges having positive orientations, so that completed indicia designs will be observed across adjoining faces.

| Edge | DPNDT |
|---|---|
| 1 | −9 |
| 2 | −17 |
| 3 | −18 |
| 4 | −26 |

-continued

| Edge | DPNDT |
|---|---|
| 5 | −27 |
| 6 | −35 |
| 7 | −36 |
| 8 | −12 |
| 9 | * |
| 10 | −20,41 |
| 11 | −33,59 |
| 12 | * |
| 13 | −45 |
| 14 | −44,60,−72 |
| 15 | −63 |
| 16 | o |
| 17 | * |
| 18 | * |
| 19 | −25,47 |
| 20 | * |
| 21 | o |
| 22 | −48 |
| 23 | −43,51,−69 |
| 24 | 42 |
| 25 | * |
| 26 | * |
| 27 | * |
| 28 | −34,53 |
| 29 | −49 |
| 30 | o |
| 31 | −55 |
| 32 | −50,54,70 |
| 33 | * |
| 34 | * |
| 35 | * |
| 36 | * |
| 37 | −57,61,−71 |
| 38 | −56 |
| 39 | o |
| 40 | −62 |
| 41 | * |
| 42 | * |
| 43 | * |
| 44 | * |
| 45 | * |
| 46 | −65,73 |
| 47 | * |
| 48 | * |
| 49 | * |
| 50 | * |
| 51 | * |
| 52 | −66,74 |
| 53 | * |
| 54 | * |
| 55 | * |
| 56 | * |
| 57 | * |
| 58 | −67,75 |
| 59 | * |
| 60 | * |
| 61 | * |
| 62 | * |
| 63 | * |
| 64 | −68,76 |
| 65 | * |
| 66 | * |
| 67 | * |
| 68 | * |
| 69 | * |
| 70 | * |
| 71 | * |
| 72 | * |
| 73 | * |
| 74 | * |
| 75 | * |
| 76 | * |
| 77 | o |
| 78 | o |
| 79 | o |
| 80 | o |

A complete description of a 10 piece pyramidal which conforms to the above conventions for edge assignments is illustrated below.

| Piece | Edge | Indicia Sign |
|---|---|---|
| Base | 1 | B − |
| | 2 | D − |
| | 3 | C + |
| | 4 | C − |
| | 5 | D + |
| | 6 | B + |
| | 7 | C − |
| | 8 | C + |
| 1st Layer Pyramids | | |
| Piece 1 | | |
| Square face | 9 | B + |
| | 10 | A + |
| | 11 | D + |
| | 12 | C − |
| Leaning edge | 13 | C + |
| | 14 | B + |
| | 15 | F + |
| | 16 | E + |
| Piece 2 | | |
| Square face | 17 | D + |
| | 18 | C − |
| | 19 | B + |
| | 20 | A − |
| Leaning edge | 21 | C + |
| | 22 | B + |
| | 23 | F + |
| | 24 | E + |
| Piece 3 | | |
| Square face | 25 | B − |
| | 26 | C + |
| | 27 | D − |
| | 28 | A − |
| Leaning edge | 29 | C + |
| | 30 | B + |
| | 31 | F + |
| | 32 | E + |
| Piece 4 | | |
| Square face | 33 | D − |
| | 34 | A + |
| | 35 | B − |
| | 36 | C + |
| Leaning edge | 37 | C + |
| | 38 | B + |
| | 39 | F + |
| | 40 | E + |
| 2nd Layer Tetrahedra | | |
| Piece 5 | | |
| Bottom edge | 41 | A + |
| | 42 | E + |
| | 43 | F + |
| | 44 | B + |
| | 45 | C + |
| Top edge | 46 | D + |
| Piece 6 | | |
| Bottom edge | 47 | B + |
| | 48 | B + |
| | 49 | C + |
| | 50 | E + |
| | 51 | F + |
| Top edge | 52 | C − |
| Piece 7 | | |
| Bottom edge | 53 | A − |
| | 54 | E + |
| | 55 | F + |
| | 56 | B + |
| | 57 | C + |
| Top edge | 58 | B − |
| Piece 8 | | |
| Bottom edge | 59 | D − |
| | 60 | B + |
| | 61 | C + |
| | 62 | E + |
| | 63 | F + |
| Top edge | 64 | A + |
| Piece 9 | | |

-continued

| Piece | Edge | Indicia Sign |
|---|---|---|
| Square face | 65 | D − |
| | 66 | C + |
| | 67 | B + |
| | 68 | A − |
| Leaning edge | 69 | F − |
| | 70 | E − |
| | 71 | C − |
| | 72 | B − |
| Piece 10 | | |
| Square face | 73 | D + |
| | 74 | C − |
| | 75 | B − |
| | 76 | A + |
| Leaning edge | 77 | F − |
| | 78 | F + |
| | 79 | B − |
| | 80 | C − |

EXAMPLE 2

ALTERNATE PYRAMID PUZZLE

Figure 17:
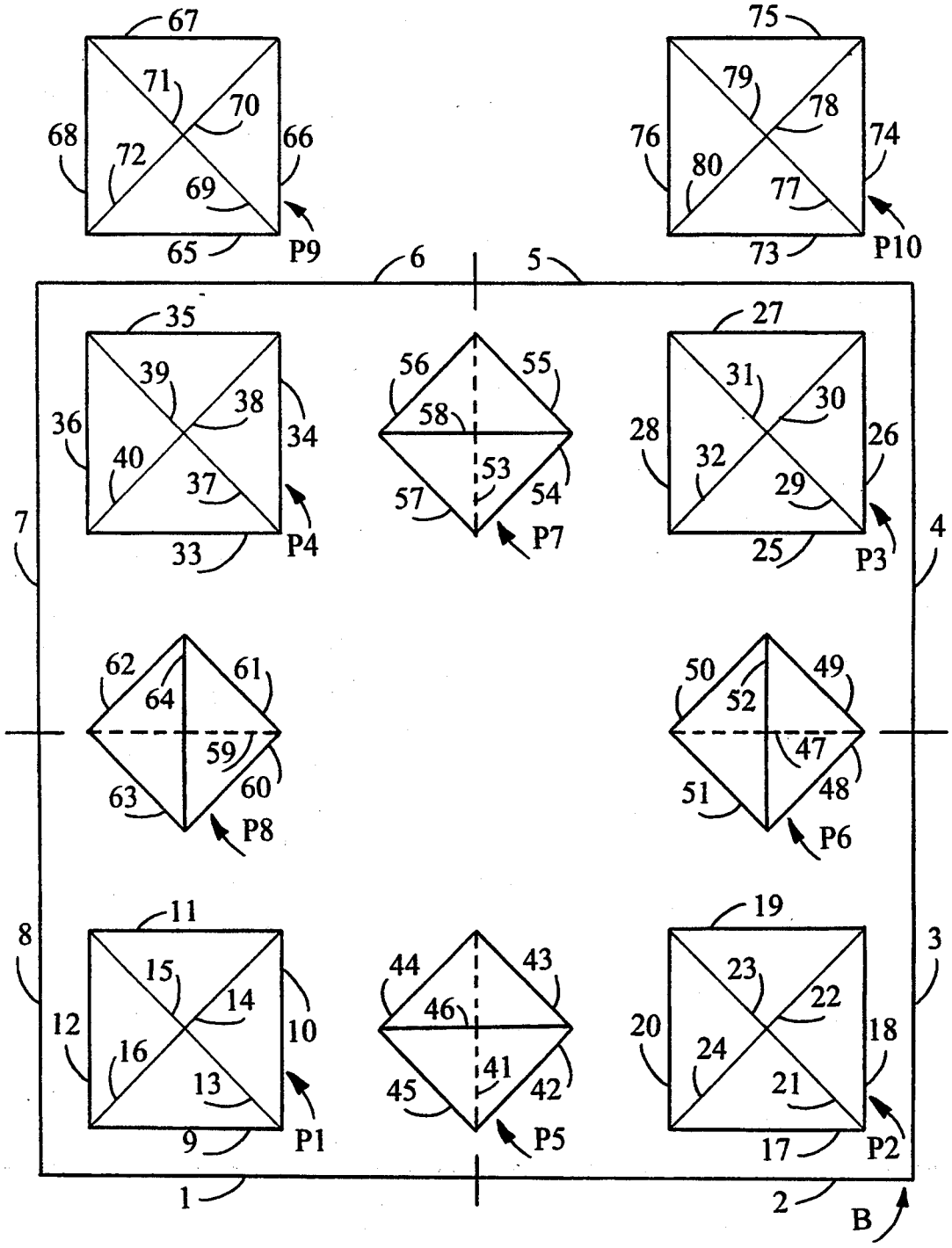
FIG. 17 is an illustration of a 10 piece puzzle in which the top pyramidal pieces are rotated 90 degrees relative to the pieces of the puzzle in FIG. 16 and also includes piece and edge number identifications.
Figure 18:
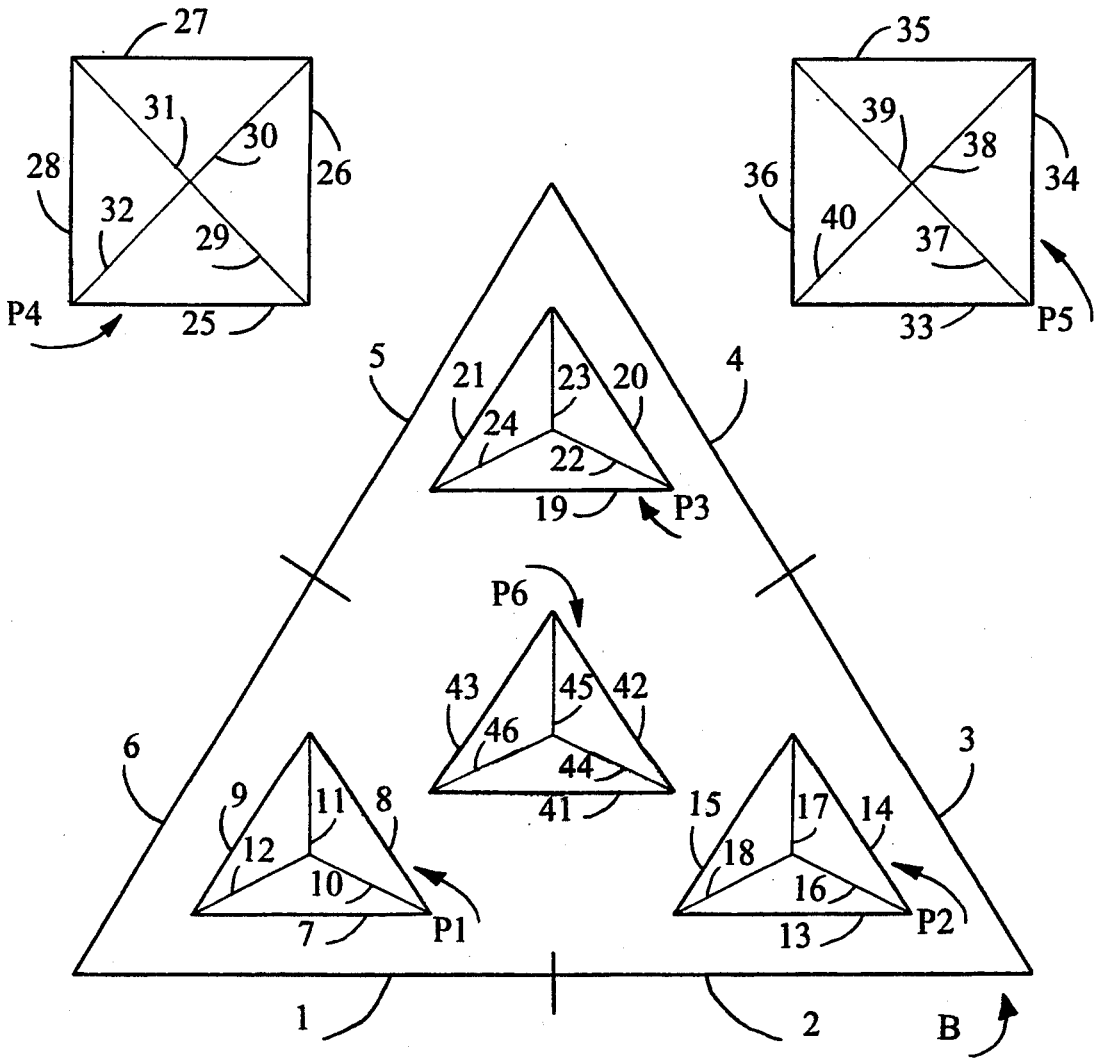
FIG. 18 defines the piece and edge numbers for a 6 piece tetrahedryl puzzle as in FIGS. 11A through 11D.

This puzzle is an example of a 10 piece pyramidal puzzle in which the center two small pyramidal pieces (pieces 9 and 10) are rotated horizontally 90 degrees relative to the same pieces in Example 1 (see FIG. 17). The conventions for assignment of the indicia on the base and pieces 1–8 are the same as in Example 1. For ease of description, the edges of pieces 9 and 10 are assigned with the pieces resting on their square bases. Their front edges are those which occur on the front face of the assembled puzzle. In this example, these two edges are adjacent to edge 23 of piece 2. As in pieces 1–4 the edges are numbered first on the square edges then on the leaning edges. The signs of the indicia on pieces 9 and 10 are assigned in the same manner as those of pieces 1–4. Thus piece 9 contains edges 65–72 and piece 10 contains edges 73–80.

With this convention one can determine which edges are interdependent and which signs they must have to be complementary with the adjacent edges of adjoining pieces. As in Example 1 the interdependent edges are summarized below.

For a 10 piece pyramidal puzzle of this configuration, the dependent edges are identified below. In this illustration, o means an independent edge and assignment is not critical, * means previously assigned as a dependent edge,—means this edge has the opposite sign to that of its primary dependent edge.

| Edge | DPNDT |
|---|---|
| 1 | −9 |
| 2 | −17 |
| 3 | −18 |
| 4 | −26 |
| 5 | −27 |
| 6 | −35 |
| 7 | −36 |
| 8 | −12 |
| 9 | * |
| 10 | −20,41 |
| 11 | −33,59 |
| 12 | * |
| 13 | −45 |
| 14 | −44,60,72 |
| 15 | −63 |
| 16 | o |
| 17 | * |
| 18 | * |
| 19 | −25,47 |
| 20 | * |

-continued

| Edge | DPNDT |
|---|---|
| 21 | o |
| 22 | −48 |
| 23 | −43,51,65,73 |
| 24 | −42 |
| 25 | * |
| 26 | * |
| 27 | * |
| 28 | −34,53 |
| 29 | −49 |
| 30 | o |
| 31 | −55 |
| 32 | −50,54,77 |
| 33 | * |
| 34 | * |
| 35 | * |
| 36 | * |
| 37 | −57,61,68,74 |
| 38 | −56 |
| 39 | o |
| 40 | −62 |
| 41 | * |
| 42 | * |
| 43 | * |
| 44 | * |
| 45 | * |
| 46 | −69 |
| 47 | * |
| 48 | * |
| 49 | * |
| 50 | * |
| 51 | * |
| 52 | −80 |
| 53 | * |
| 54 | * |
| 55 | * |
| 56 | * |
| 57 | * |
| 58 | −78 |
| 59 | * |
| 60 | * |
| 61 | * |
| 62 | * |
| 63 | * |
| 64 | −71 |
| 65 | * |
| 66 | −76 |
| 67 | −75 |
| 68 | * |
| 69 | * |
| 70 | o |
| 71 | * |
| 72 | * |
| 73 | * |
| 74 | * |
| 75 | * |
| 76 | * |
| 77 | * |
| 78 | * |
| 79 | o |
| 80 | * |

A complete description of a 10 piece pyramidal which conforms to the above conventions for edge assignments is illustrated below.

| Piece | Edge | Indicia Sign |
|---|---|---|
| Base | 1 | B − |
| | 2 | D − |
| | 3 | C + |
| | 4 | C − |
| | 5 | D + |
| | 6 | B + |
| | 7 | C − |
| | 8 | C + |
| 1st Layer Pyramids | | |
| Piece 1 | | |
| Square face | 9 | B + |

-continued

| Piece | Edge | Indicia Sign |
|---|---|---|
| | 10 | A + |
| | 11 | D + |
| | 12 | C − |
| Leaning edge | 13 | C + |
| | 14 | B + |
| | 15 | F + |
| | 16 | E + |
| Piece 2 | | |
| Square face | 17 | D + |
| | 18 | C − |
| | 19 | B + |
| | 20 | A − |
| Leaning edge | 21 | C + |
| | 22 | F + |
| | 23 | B + |
| | 24 | E + |
| Piece 3 | | |
| Square face | 25 | B − |
| | 26 | C + |
| | 27 | D − |
| | 28 | A − |
| Leaning edge | 29 | C + |
| | 30 | B + |
| | 31 | F + |
| | 32 | E + |
| Piece 4 | | |
| Square face | 33 | D − |
| | 34 | A + |
| | 35 | B − |
| | 36 | C + |
| Leaning edge | 37 | C + |
| | 38 | B + |
| | 39 | F + |
| | 40 | E + |
| 2nd Layer Tetrahedra | | |
| Piece 5 | | |
| Bottom edge | 41 | A + |
| | 42 | E + |
| | 43 | B + |
| | 44 | B + |
| | 45 | C + |
| Top edge | 46 | D + |
| Piece 6 | | |
| Bottom edge | 47 | B + |
| | 48 | F + |
| | 49 | C + |
| | 50 | E + |
| | 51 | B + |
| Top edge | 52 | D − |
| Piece 7 | | |
| Bottom edge | 53 | A − |
| | 54 | E + |
| | 55 | F + |
| | 56 | B + |
| | 57 | C + |
| Top edge | 58 | B − |
| Piece 8 | | |
| Bottom edge | 59 | D − |
| | 60 | B + |
| | 61 | C + |
| | 62 | E + |
| | 63 | F + |
| Top edge | 64 | C + |
| Piece 9 | | |
| Square face | 65 | B + |
| | 66 | A + |
| | 67 | D + |
| | 68 | C + |
| Leaning edge | 69 | D + |
| | 70 | C − |
| | 71 | C + |
| | 72 | B + |
| Piece 10 | | |
| Square face | 73 | B + |
| | 74 | C − |
| | 75 | D + |
| | 76 | A − |
| Leaning edge | 77 | E + |

-continued

| Piece | Edge | Indicia Sign |
|---|---|---|
| | 78 | B + |
| | 79 | F + |
| | 80 | D + |

EXAMPLE 3

6 PIECE TETRAHEDRYL PUZZLE

This puzzle has a tetrahedryl shape composed of 6 pieces. There are 4 smaller tetrahedra, 2 pyramids and a base. There are 46 edges which overlap (24 are unique). The edges are numbered sequentially on the pieces placed in their normal configurations in the assembled puzzle (see FIG. 18). Starting with piece 1 placed on the base in the 7:30 position of a clock face when viewing the puzzle from above. By convention edges 1 and 2 form the reference line for assigning numbers to the edges. Edges 1–6 on the base, are numbered on the base in counter clockwise direction starting with the left most comer.

The bottom tetrahedryl pieces are assigned numbers 1–3. The other tetrahedryl piece is assigned number 6. The assembled puzzle has pieces 1–3 placed on the base in a counter clockwise direction starting at edge 1 of the base. The edges of pieces 1–3 are similarly assigned numbers in a counter clockwise direction. The leaning edges are numbered, starting with the right most edge closest to the reference base edge (1 and 2). The tetrahedryl base edges are numbered first. Thus, the edge numbers of the 5 tetrahedryl pieces 1,2,3 and 6 are: piece 1=edges 7–12, piece 2=13–18 piece 3=19–24, and piece 6=41–46.

Pyramidal pieces are assigned pieces 4 and 5, with piece 4 being the left most piece in the assembled puzzle with its apex touching the base at the intersection of edges 5 and 6. The square faces of the pyramidal pieces face each other and the apex of piece 5 touches the apex of piece 2.

The edges of these pyramidal pieces are sequentially numbered counter clockwise first around the square face edges, then around the leaning edges. The starting edge in both cases is that edge which lies on the front right leaning edge of piece 1. Thus, the corresponding edges of the pyramidal pieces are: piece 4=edges 25–32 and piece 5=33–40.

To construct the puzzle, enter the desired indicia and their orientations on the edge locations starting with base. The edges of the pieces are then assigned in sequential order, first the edges of piece 1 in increasing edge number, then piece 2, etc. By convention, indicia which point toward the apex of tetrahedryl pieces are assigned −1. Pointing toward the tetrahedryl base is assigned −1. On the leaning edges, a counterclockwise orientation is assigned a +1. The edges of the tetrahedryl pieces which adjoin the base are dependent on the previous assignments on the base edges. Therefore, they are assigned the same indicia with the opposite sign as the base edges which they adjoin. The leaning edges of the tetrahedryl bottom pieces are assigned in any desired manner. Having assigned these edges, the pyramidal piece edges which adjoin them are similarly assigned such that when the puzzle is assembled, each face both interior and exterior forms completed indicia across all adjoining edges. By convention, the pyramidal piece edges are assigned a +1 if the indicia of the square face edges point toward the apex and the if leaning edges point in a counter clockwise direction, when viewed from the apex.

With this convention one can determine which edges are interdependent and which signs they must have to be complementary with the adjacent edges of adjoining pieces. As in Example 1 the interdependent edges are summarized below. For a 6 piece tetrahedryl puzzle of this configuration, the dependent edges are identified below. In this illustration, o means an independent edge and assignment is not critical, * means previously assigned as a dependent edge, - means this edge has the opposite orientation of the first assigned primary dependent edge.

| Edge | DPNDT |
|---|---|
| 1 | −7 |
| 2 | −13 |
| 3 | −14 |
| 4 | −20 |
| 5 | −21 |
| 6 | −9 |
| 7 | * |
| 8 | −32 |
| 9 | * |
| 10 | −25,33 |
| 11 | −29 |
| 12 | o |
| 13 | * |
| 14 | * |
| 15 | 28,−34 |
| 16 | o |
| 17 | 38 |
| 18 | 37 |
| 19 | 31 |
| 20 | * |
| 21 | * |
| 22 | 27,−35 |
| 23 | * |
| 24 | −30 |
| 25 | * |
| 26 | −36,−43 |
| 27 | * |
| 28 | * |
| 29 | * |
| 30 | * |
| 31 | * |
| 32 | * |
| 33 | * |
| 34 | * |
| 35 | * |
| 36 | * |
| 37 | * |
| 38 | * |
| 39 | 42 |
| 40 | −41 |
| 41 | * |
| 42 | * |
| 43 | * |
| 44 | o |
| 45 | o |
| 46 | o |

A complete description of a 6 piece tetrahedryl puzzle which conforms to the above edge assignments is listed below.

| Piece | Edge | Indicia Sign |
|---|---|---|
| Base | 1 | A + |
| | 2 | B − |
| | 3 | A − |
| | 4 | B + |
| | 5 | A + |
| | 6 | B + |
| 1st Layer Tetrahedra Piece 1 | | |
| Triangular base | 7 | A − |

-continued

| Piece | Edge | Indicia Sign |
|---|---|---|
| | 8 | C + |
| | 9 | B − |
| Leaning edge | 10 | D + |
| | 11 | C + |
| | 12 | B + |
| Piece 2 | | |
| Triangular base | 13 | B + |
| | 14 | A + |
| | 15 | C − |
| Leaning edge | 16 | D + |
| | 17 | C + |
| | 18 | B + |
| Piece 3 | | |
| Triangular Base | 19 | C + |
| | 20 | B − |
| | 21 | A − |
| Leaning edge | 22 | D + |
| | 23 | C + |
| | 24 | B + |
| Piece 4 | | |
| Square face | 25 | D − |
| | 26 | C + |
| | 27 | D + |
| | 28 | C − |
| Leaning edge | 29 | C − |
| | 30 | B − |
| | 31 | C + |
| | 32 | C − |
| Piece 5 | | |
| Square face | 33 | D + |
| | 34 | C + |
| | 35 | D − |
| | 36 | C − |
| Leaning edge | 37 | B + |
| | 38 | C + |
| | 39 | A − |
| | 40 | B + |
| Top Tetrahedra Piece 6 | | |
| Triangular base | 41 | B − |
| | 42 | A − |
| | 43 | C − |
| Leaning edge | 44 | D + |
| | 45 | C + |
| | 46 | B + |

EXAMPLE 4

DUAL PYRAMID PUZZLE

This example illustrates a combination puzzle in which the pieces can be assembled into a 10 piece pyramidal puzzle as well as a 6 piece tetrahedryl puzzle. The assignment of piece and edge numbers are the same as in Examples 1 and 3, however, the interdependence of the edges with one another are more restricted than for either the 10 piece or 6 puzzles. The interdependence of the indicia in a puzzle of this type is illustrated below.

For a dual 6 and 10 piece pyramidal puzzle of this configuration, the dependent edges are identified below. In this illustration, o means an independent edge and assignment is not critical, * means previously assigned as a dependent edge, - means this edge has the opposite orientation of the first assigned interdependent edge.

| Edge | DPNDT |
|---|---|
| 1 | −9,−19,25,−47 |
| 2 | −17 |
| 3 | −18 |
| 4 | −8,12,−26 |
| 5 | 11,−27,−33,59 |
| 6 | −35 |

-continued

| Edge | DPNDT |
|---|---|
| 7 | −36 |
| 8 | * |
| 9 | * |
| 10 | −20,−28,41,34,−53 |
| 11 | * |
| 12 | * |
| 13 | −45 |
| 14 | −44,60,−72 |
| 15 | −63 |
| 16 | o |
| 17 | * |
| 18 | * |
| 19 | * |
| 20 | * |
| 21 | o |
| 22 | −48 |
| 23 | −43,51,−69 |
| 24 | −42 |
| 25 | * |
| 26 | * |
| 27 | * |
| 28 | * |
| 29 | −49 |
| 30 | o |
| 31 | −55 |
| 32 | −50,54,−70 |
| 33 | * |
| 34 | * |
| 35 | * |
| 36 | * |
| 37 | −57,61,−71 |
| 38 | −56 |
| 39 | o |
| 40 | −62 |
| 41 | * |
| 42 | * |
| 43 | * |
| 44 | * |
| 45 | * |
| 46 | −65,73 |
| 47 | * |
| 48 | * |
| 49 | * |
| 50 | * |
| 51 | * |
| 52 | −66,74 |
| 53 | * |
| 54 | * |
| 55 | * |
| 56 | * |
| 57 | * |
| 58 | −67,75 |
| 59 | * |
| 60 | * |
| 61 | * |
| 62 | * |
| 63 | * |
| 64 | −68,76 |
| 65 | * |
| 66 | * |
| 67 | * |
| 68 | * |
| 69 | * |
| 70 | * |
| 71 | * |
| 72 | * |
| 73 | * |
| 74 | * |
| 75 | * |
| 76 | * |
| 77 | o |
| 78 | o |
| 79 | o |
| 80 | o |

An example of a combination puzzle which conforms to the assignments described above is illustrated below.

| Piece | Edge | Indicia Sign |
|---|---|---|
| Base | 1 | A + |
| | 2 | C − |
| | 3 | D + |
| | 4 | D − |
| | 5 | C + |
| | 6 | A + |
| | 7 | D + |
| | 8 | D + |
| 1st Layer Pyramids | | |
| Piece 1 | | |
| Square face | 9 | A − |
| | 10 | B + |
| | 11 | C − |
| | 12 | D − |
| Leaning edge | 13 | F + |
| | 14 | A + |
| | 15 | D + |
| | 16 | E + |
| Piece 2 | | |
| Square face | 17 | C + |
| | 18 | D − |
| | 19 | A + |
| | 20 | B − |
| Leaning edge | 21 | F + |
| | 22 | A + |
| | 23 | D + |
| | 24 | E + |
| Piece 3 | | |
| Square face | 25 | A + |
| | 26 | D + |
| | 27 | C − |
| | 28 | B − |
| Leaning edge | 29 | F + |
| | 30 | A + |
| | 31 | D + |
| | 32 | E + |
| Piece 4 | | |
| Square face | 33 | C + |
| | 34 | B + |
| | 35 | A − |
| | 36 | D − |
| Leaning edge | 37 | F + |
| | 38 | A + |
| | 39 | D + |
| | 40 | E + |
| 2nd Layer Tetrahedra | | |
| Piece 5 | | |
| Bottom edge | 41 | B + |
| | 42 | E + |
| | 43 | D + |
| | 44 | A + |
| | 45 | F + |
| Top edge | 46 | A + |
| Piece 6 | | |
| Bottom edge | 47 | A + |
| | 48 | A + |
| | 49 | F + |
| | 50 | E + |
| | 51 | D + |
| Top edge | 52 | B − |
| Piece 7 | | |
| Bottom edge | 53 | B − |
| | 54 | E + |
| | 55 | D + |
| | 56 | A + |
| | 57 | F + |
| Top edge | 58 | C + |
| Piece 8 | | |
| Bottom edge | 59 | C + |
| | 60 | A + |
| | 61 | F + |
| | 62 | E + |
| | 63 | D + |
| Top edge | 64 | D − |
| Piece 9 | | |
| Square face | 65 | A − |
| | 66 | B + |
| | 67 | C − |

-continued

| Piece | Edge | Indicia Sign |
|---|---|---|
| | 68 | D + |
| Leaning edge | 69 | D − |
| | 70 | E − |
| | 71 | F − |
| | 72 | A − |
| Piece 10 | | |
| Square face | 73 | A + |
| | 74 | B − |
| | 75 | C + |
| | 76 | D − |
| Leaning edge | 77 | F + |
| | 78 | A + |
| | 79 | D + |
| | 80 | E + |

DUAL 6 PIECE TETRAHEDRYL PUZZLE

| Piece | Edge | Indicia Sign |
|---|---|---|
| Base | 1 | C + |
| | 2 | F − |
| | 3 | B − |
| | 4 | D + |
| | 5 | E + |
| | 6 | A − |
| 1st Layer Tetrahedra | | |
| Piece 1 | | |
| Triangular base | 7 | C − |
| | 8 | D − |
| | 9 | A + |
| Leaning edge | 10 | E + |
| | 11 | D − |
| | 12 | F + |
| Piece 2 | | |
| Triangular base | 13 | F + |
| | 14 | B + |
| | 15 | A − |
| Leaning edge | 16 | E + |
| | 17 | D + |
| | 18 | C + |
| Piece 3 | | |
| Triangular Base | 19 | A + |
| | 20 | D − |
| | 21 | E − |
| Leaning edge | 22 | B − |
| | 23 | A − |
| | 24 | A − |
| Piece 4 | | |
| Square face | 25 | E − |
| | 26 | A − |
| | 27 | B − |
| | 28 | A − |
| Leaning edge | 29 | D + |
| | 30 | A + |
| | 31 | A + |
| | 32 | D + |
| Piece 5 | | |
| Square face | 33 | E + |
| | 34 | A + |
| | 35 | B + |
| | 36 | A + |
| Leaning edge | 37 | C + |
| | 38 | D + |
| | 39 | E + |
| | 40 | F + |
| Top Tetrahedra | | |
| Piece 6 | | |
| Triangular base | 41 | F − |
| | 42 | E + |
| | 43 | A + |
| Leaning edge | 44 | B − |
| | 45 | D + |
| | 46 | A + |

I claim:

1. A three-dimensional, geometric puzzle game apparatus comprising:

four regular four-sided puzzle pieces, each having six edges, each four-sided piece having at least six indicia thereon, wherein each edge of each said four-sided puzzle piece includes at least one of said indicia which overlaps each said edge; and, six regular five-sided puzzle pieces, each having eight edges, each five-sided piece having at least eight indicia thereon, wherein each edge of each said five-sided puzzle piece includes at least one of said indicia which overlaps each said edge; and, a base which includes at least eight indicia thereon onto which the puzzle pieces are assembled, wherein said indicia are arranged in such a way that when all ten puzzle pieces are properly assembled on the base, abutting edges of adjacent puzzle pieces and edges on the base include matching indicia that complete a design, and, wherein, when any puzzle piece is removed, the indicia on the edges of the remaining puzzle pieces complete a design on the interior of said assembled puzzle.

2. A three-dimensional, geometric puzzle game apparatus comprising:

a plurality of N regular four-sided puzzle pieces, each having at least X indicia thereon, wherein each edge of each said four-sided puzzle piece includes at least one of said indicia which overlaps each said edge; and, a plurality of M regular five-sided puzzle pieces, each including at least Y indicia thereon, wherein each edge of each said five-sided puzzle piece includes at least one of said indicia which overlaps each said edge; and, a base which includes at least Z indicia thereon onto which the puzzle pieces are assembled, wherein said indicia are arranged in such a way that when all puzzle pieces are properly assembled on the base, abutting edges of adjacent puzzle pieces and edges on the base include matching indicia that complete a design, and, wherein, when any puzzle piece is removed, the indicia on the edges of the remaining puzzle pieces complete a design on the interior of said assembled puzzle.

3. A three-dimensional, geometric puzzle game apparatus comprising:

a plurality of N regular four-sided puzzle pieces, each having at least X indicia thereon, wherein each edge of each said four-sided puzzle piece includes at least one of said indicia which overlaps each said edge; and, a plurality of M regular five-sided puzzle pieces, each including at least Y indicia thereon, wherein each edge of each said five-sided puzzle piece includes at least one of said indicia which overlaps each said edge; and, a base which includes at least Z indicia thereon onto which the puzzle pieces are assembled, wherein said indicia are arranged in such a way that when all puzzle pieces are properly assembled, abutting edges of adjacent puzzle pieces include matching indicia that complete a design, and, wherein, when any puzzle piece is removed, the indicia on the edges of the remaining puzzle pieces complete a design on the interior of said assembled puzzle.

4. The apparatus of claim 3 wherein X equals at least 2 and Y equals at least 2.

5. The apparatus of claim 4 wherein N equals at least 4 and M equals at least 2.

6. The apparatus of claim 5 wherein N equals at least 4 and M equals at least 6.

7. The apparatus of claim 6 further comprising:

a base which includes at least 2 indicia thereon, onto which the puzzle pieces are assembled, wherein said indicia are arranged in such a way that when all puzzle pieces are properly assembled on the base, abutting edges of adjacent puzzle pieces and edges on the base include matching indicia that complete a design, and, wherein, when any puzzle piece is removed, the indicia on the edges of the remaining puzzle pieces complete a design on the interior of said assembled puzzle.

8. The apparatus of claim 6 further comprising:

a base onto which the puzzle pieces are assembled, wherein said indicia are arranged in such a way that when all puzzle pieces are properly assembled on the base, abutting edges of adjacent puzzle pieces include matching indicia that complete a design, and, wherein, when any puzzle piece is removed, the indicia on the edges of the remaining puzzle pieces complete a design on the interior of said assembled puzzle.

9. A three-dimensional, geometric puzzle game apparatus comprising:

four regular four-sided puzzle pieces, each having six edges, each four-sided piece having at least six indicia thereon, wherein each edge includes at least one of said indicia which overlaps each said edge; and, six regular five-sided puzzle pieces, each having eight edges, each five-sided piece having at least eight indicia thereon, wherein each edge includes at least one of said indicia which overlaps each said edge, wherein said indicia are arranged in such a way that when all puzzle pieces are properly assembled, abutting edges of adjacent puzzle pieces include matching indicia that complete a design, and, wherein, when any puzzle piece is removed, the indicia on the edges of the remaining puzzle pieces complete a design on the interior of said assembled puzzle.

10. The apparatus of claim 9 further comprising:

a base onto which the puzzle pieces are assembled, wherein said indicia are arranged in such a way that when all puzzle pieces are properly assembled on the base, abutting edges of adjacent puzzle pieces include matching indicia that complete a design, and, wherein, when any puzzle piece is removed, the indicia on the edges of the remaining puzzle pieces complete a design on the interior of said assembled puzzle.

11. The apparatus of claim 10 in which the base includes at least 2 indicia thereon, onto which the puzzle pieces are assembled, wherein said indicia are arranged in such a way that when all puzzle pieces are properly assembled on the base, abutting edges of adjacent puzzle pieces and edges on the base include matching indicia that complete a design, and, wherein, when any puzzle piece is removed, the indicia on the edges of the remaining puzzle pieces complete a design on the interior of said assembled puzzle.

* * * * *